US005251386A

United States Patent [19]

Diaz

[11] Patent Number: 5,251,386

[45] Date of Patent: * Oct. 12, 1993

[54] PROTECTIVE COVER FOR SHOES, BOOTS AND THE LIKE

[76] Inventor: Vincent Diaz, 504-03 Eastview Ter., Abingdon, Md. 21009

[ * ] Notice: The portion of the term of this patent subsequent to Dec. 22, 2009 has been disclaimed.

[21] Appl. No.: 764,605

[22] Filed: Sep. 20, 1991

Related U.S. Application Data

[63] Continuation-in-part of Ser. No. 746,054, Aug. 12, 1991, Pat. No. 5,172,493, which is a continuation of Ser. No. 445,788, Nov. 29, 1989, abandoned.

[51] Int. Cl.[5] ..... A41D 17/00

[52] U.S. Cl. ..... 36/2 R; 36/1.5; 36/72 R

[58] Field of Search ..... 2/22, DIG. 6; 36/1 R, 36/2 R, 9 R, 1.5, 96, 133, 77 R, 72 R

[56] References Cited

U.S. PATENT DOCUMENTS

| | | | |
|---|---|---|---|
| D. 60,684 | 3/1922 | Jenkins . | |
| D. 160,743 | 10/1950 | Richardson . | |
| D. 169,889 | 6/1953 | Bollenbach . | |
| D. 288,382 | 2/1987 | Birchwood | D2/314 |
| D. 306,921 | 3/1990 | Pettinelli . | |
| 48,897 | 7/1865 | Blodgett . | |
| 155,968 | 10/1874 | Owens . | |
| 230,498 | 7/1880 | Riese . | |
| 540,889 | 6/1895 | Allen . | |
| 951,986 | 3/1910 | Daniel . | |
| 1,032,643 | 7/1912 | Allsopp . | |
| 1,132,835 | 3/1915 | Dehler . | |
| 1,458,717 | 6/1923 | Lochwitzky | 36/9 R |
| 1,463,357 | 7/1923 | Brown . | |
| 1,606,862 | 11/1928 | Zenishek . | |
| 1,610,378 | 12/1926 | Hogan . | |
| 1,709,541 | 4/1929 | Rauh . | |
| 2,099,476 | 11/1937 | Glowka | 36/2 R |
| 2,249,553 | 7/1941 | Cataffo | 2/22 X |
| 2,333,373 | 11/1943 | Grey | 36/9 R X |
| 2,446,158 | 7/1948 | Miller et al. . | |
| 2,657,477 | 11/1953 | Winslow . | |
| 2,757,460 | 8/1956 | Bufis | 36/2 |
| 2,872,745 | 2/1959 | Finegan | 36/2 |

(List continued on next page.)

FOREIGN PATENT DOCUMENTS 4084 of 1904 United Kingdom .

OTHER PUBLICATIONS

Journal of AMA vol. 68, No. 7, Gershman, M.D. Oct. 18, 1958.

U.S. Department of Agriculture, Forest Service, Specification 6170-4D, Jan. 1989, Chaps, Chainsaw.

U.K. Application, Serial No. 2,219,727A to Frith et al, published Dec. 20, 1989.

*Primary Examiner*—Steven N. Meyers
*Assistant Examiner*—Ted Kavanaugh
*Attorney, Agent, or Firm*—Leonard Bloom

[57] ABSTRACT

A flexible protective cover for boots, shoes and the like to protect the wearer from injury from a chainsaw. The cover has a lining of layers of high modulus fiber fabric between an inner layer and a outer layer of durable fabric. The lining is secured between the inner layer and the outer layer by a quilt-like stitching. The protective cover is folded to conform to the instep of the shoe and extend to the ankle. A strap and fasteners are attached to the cover to permit the cover to be secured over the shoe in a rapid and easy manner. In a preferred embodiment, a tab is formed on one side of the cover and a bail is attached to the other side of the cover. The tab is pulled through the bail and returned approximately 180° to the one side of the cover. The tab is held by quick-release fasteners to the one side of the cover thereby firmly securing the cover longitudinally to the boot or shoe. Transverse fastening means are provided between the lower edge of the side portions of the cover and the sole plane of the shoe. A cord formed of lining fibers is attached to the lower edge of the side portions of the cover to provide additional protection to the edge of the cover.

16 Claims, 13 Drawing Sheets

U.S. PATENT DOCUMENTS

| | | | |
|---|---|---|---|
| 2,884,646 | 5/1959 | Alber | 36/2 R |
| 2,902,779 | 9/1959 | Cook | 36/2 |
| 2,945,308 | 7/1960 | Pence | 36/2 |
| 3,003,261 | 10/1961 | Graham et al. | 36/2 |
| 3,128,565 | 4/1964 | Graham et al. | 36/2 |
| 3,271,888 | 9/1966 | Graham et al. . | |
| 3,383,708 | 5/1968 | Pappas | 2/22 |
| 4,079,527 | 3/1978 | Antonius | 36/51 |
| 4,254,563 | 3/1981 | Bruno | 36/9 R |
| 4,273,130 | 6/1981 | Simpson | 2/DIG. 6 X |
| 4,279,956 | 7/1981 | Bartels | 2/22 X |
| 4,282,657 | 8/1981 | Antonious | 2/DIG. 6 X |
| 4,300,294 | 11/1981 | Riecken | 36/101 X |
| 4,308,672 | 1/1982 | Antonious | 2/DIG. 6 X |
| 4,503,566 | 3/1985 | Wheeler | 2/22 |
| 4,526,828 | 7/1985 | Fogt et al. | 428/229 |
| 4,665,633 | 5/1987 | Edgerton | 36/2 R |
| 4,689,902 | 9/1987 | Lewis, Jr. | 2/DIG. 6 X |
| 4,713,895 | 12/1987 | Vallieres | 36/1.5 |
| 4,769,854 | 9/1988 | Williams | 2/22 |
| 4,941,213 | 7/1990 | Grilliot et al. | 36/1.5 X |
| 5,087,499 | 2/1992 | Sullivan | 2/21 X |
| 5,119,512 | 6/1992 | Dunbar et al. | 2/167 |
| 5,172,493 | 12/1992 | Diaz | 36/2 R |

PROTECTIVE COVER FOR SHOES, BOOTS AND THE LIKE

CROSS REFERENCE TO RELATED APPLICATIONS

The present application is a continuation-in-part application of copending application Ser. No. 746,054 filed Aug. 12, 1991 now U.S. Pat. No. 5,172,493 which is a filed wrapper continuation of Ser. No. 445,788 now abandoned, filed Nov. 29, 1989, and the respective disclosures of these pending applications are incorporated by reference herein in their entireties.

FIELD OF THE INVENTION

The present invention relates to a removable flexible protective cover for shoes, boots and the like and, more particularly, to a cover made of fibers which bind a chainsaw and a cover which is secured to the shoe or boot in a manner to preclude separation therefrom when contacted by the blade of a chainsaw.

BACKGROUND OF THE INVENTION

The widespread use of chainsaws and similar high speed cutting devices, both commercially and individually to cut timber, other forest products and lumber, has resulted in many serious injuries to the suers. The frequency and magnitude of these injuries have been a major concern to safety organizations, employers and insurance companies. Numerous protective and safety measures and devices have been proposed to protect the users of these devices.

Of interest to the present invention are the following:

| U.S. Pat. No. | Inventor(s) | Date of Issue |
|---|---|---|
| 2,757,460 | Bufis | 08/07/56 |
| 2,872,745 | Finegan | 02/10/59 |
| 2,902,779 | Cook | 09/08/59 |
| 2,945,308 | Pence | 07/19/60 |
| 3,003,261 | Graham et al | 10/10/61 |
| 3,128,565 | Graham et al | 04/14/64 |
| 4,079,527 | Antonius | 03/21/78 |
| 4,503,566 | Wheeler | 03/12/85 |
| 4,526,828 | Fogt et al | 07/02/85 |
| D 288,382 | Birchwood | 02/24/87 |
| 4,665,633 | Edgerton | 05/19/87. |

Bufis discloses a pants protector formed of a thin waterproof material adapted to be fitted over the lower portion of the trousers leg and the upper part of the shoe to protect the same against the elements.

Finegan discloses a spat-like protector of duckbill design having a cuff of pliable leather to wrap around the ankle and a foot covering portion of tough flexible leather. The device is to protect the wearer from the shock of falling objects and to guard against spills.

Two piece rigid leggings constructed of resinous fiber reinforced plastic which encircle the leg from the knee to the vamp of the shoe are disclosed by Cook.

Pence discloses a metal snake guard comprised of two contoured sides hinged by leather strips. The protector extends from the knee to the ankle.

Graham et al, in both references, disclose a hunting boot protector having two pieces; a foot covering member and a leg covering member attached to the foot covering member. The device is constructed of a fiber impregnated resin plastic.

Antonius discloses a shoe having a flap, tab or strap to maintain a constant tautness across the toes, arch and ankle of the wearer. A continuous variable attachment means is provided.

Wheeler discloses a device to protect feet and legs against molten metal contact comprising a two-piece upper portion which wraps around a user's lower leg and a stiff flare portion to cover the top of the user's shoe.

Fogt et al disclose a protective material for gloves, leggings, aprons, sleeves and the like. The material comprises a textile base material, an intermediate layer of para aramid fiber having large pores and an outer layer of an elastomeric material. The elastomeric material extends through the pores of the intermediate layer.

Birchwood discloses a flexible shoe/boot heel protector.

Edgerton discloses a shoe top cover formed of a single thickness of flexible fabric to protect the shoe upper from paint or plastic dripping.

None of these references are directed toward providing protection to users of high speed cutting tools and which also permit the user to wear the protective device while engaged in normal walking and working situations. Even leather boots and so-called "safety shoes" do not provide protection against a high speed chainsaw.

U.K. Patent No. 4084 issued to Budischowsky, Mar. 31, 1904 discloses a cloth on leather gaiter formed of two pieces sewn together. A strip is provided to encircle the wearer's ankle so the gaiter can be worn over the user's shoe.

The applicant is aware of one type of protective device designed for use with chainsaws which is a protective chaps type of garment. The chaps are more fully described in Specification 6170-4D, January 1989 for Chaps, Chainsaw, published by the U.S. Department of Agriculture, Forest Service which covers the requirements for nylon covered para aramid chainsaw chaps. The chaps, which are intended for use by workers operating chainsaws, are cut resistant and provide protection for the legs and lower torso area. These chaps are widely used by employees in the lumber industry, but despite this use, there is still a disturbingly high incidence of serious injuries to the feet of employees caused by accidents with chainsaws.

U.K. Patent Application No. 2,219,727A, published Dec. 20, 1989, disclosed an item of protective clothing having a layer which is designed to "strand" when contacted by a chainsaw blade. The length of any strand of the material is considerably longer than the length or breadth of the actual fabric layer.

Thus, there exists an urgent need to provide a protective device to cover the feet and ankles, including shoes and the like, of persons using high speed cutting devices such as chainsaws.

SUMMARY OF THE INVENTION

Accordingly, it is a primary object of the present invention to protect the user of high speed cutting devices such as chainsaws from serious injury by providing a cover for feet, ankles, shoes and the like.

It is a further object of the present invention to provide a protective cover for shoes and the like which is simple and easy to secure over the shoe, which will remain in place, and which may be worn comfortably for extended periods.

It is yet a further object of the present invention to provide a protective cover for shoes and the like which is cut and abrasion resistant.

It is another object of the present invention to provide a protective cover for shoes and the like which is securely held on the user's shoe and prevented from dislodgement when the cover is contacted by a chainsaw.

In accordance with the teachings of the present invention, there is disclosed a removable cover intended to protect the foot of a person, particularly when the person is using a chainsaw to cut timber and the like. The cover is wrapped around the shoe or boot on the person's foot and is substantially universal for a variety of shoe sizes. The shoe or boot includes a toe portion, an instep, a sole plane, side portions joining the instep and sole plane, respectively, and a back portion. The cover includes a flexible multi-layer unitary member including an inner fabric layer, an outer fabric layer and a lining means therebetween. The lining means grabs the chainsaw and substantially binds the same in the event the chainsaw is accidentally brought into contact with the cover and cuts into the cover. The cover further includes a substantially-flat member having a central forwardly-disposed upwardly projecting portion slipped over the toe portion and instep of the shoe or boot. The shoe or boot is received within the cover as the cover is wrapped around the shoe or boot. The cover has respective side portions including a first side portion and a second side portion. Each side portion has a respective upper portion and a respective lower portion. The upper portion of each side curves downwardly toward the back portion of the shoe and the lower portion of each side curves upwardly toward the back portion of the shoe or boot. The first side portion has a rearwardly-extending tab formed thereon. The tab has a vertical height extending substantially between the upwardly curving portion and the downwardly curving portion of side portions of the cover. The second side portion has a bail thereon through which the tab is received. The tab is grasped and pulled through, and approximately 180° around the bail to tighten the cover on the shoe or boot. Quick-release fastening means are provided between the tab and the first side portion of the cover to secure the cover to the shoe or boot longitudinally thereof. Means are provided for detachably securing the lower portion of each side portion of the cover to the sole plane of the shoe or boot. In this manner the cover is precluded from being separated from the shoe or boot upon initial contact between the chainsaw and the cover.

The lining means may be at least one layer of a woven para aramid fabric and at least one adjacent layer of a non-woven para aramid fabric. In a preferred embodiment, the lining means and the side portions of the cover are joined together by stitching in a quilt like pattern.

A cord of lining means material is attached to the lower edge of the cover where contact is made with the chainsaw so that the cord may bind the chainsaw.

It is preferred that the means for detachably securing the lower portion of the cover to the shoe or boot is a plurality of transverse spaced-apart fastening means mounted on the cover. These fastening means cooperate with a corresponding plurality of spaced-apart fastening means on the sole plane of the shoe or boot.

A satisfactory device to provide protection to the shoe, boot and ankle of a chainsaw operator was disclosed in U.S. patent application Ser. No. 746,054. In that disclosure, a protective cover is provided having an para aramid fabric lining and designed to be worn over a shoe or boot. However, there still exists room for improvement of the structure of the protective cover to provide greater safety to the operator of a chainsaw.

It is very important to adequately and positively secure the protective cover to the shoe or boot of the chainsaw operator in a manner to assure that the protective cover is not separated from the shoe or boot as a result of the forces applied to the cover by contact with the high speed blade of the chainsaw. The protective cover must be held firmly about the ankle of the wearer so that movement of the protective cover away from the ankle is prevented. Also, the cover cannot have open sides and must be held close to the shoe or boot so that, while worn, underbrush and other objects cannot enter between the boot and the cover and hinder the normal walking of the wearer. Furthermore, the front of the cover which is protecting the toe and instep portions of the shoe or boot, must be held firmly in place. Contact of this portion of the cover, which is the most probable point of contact by a chainsaw, will result in separating of the cover from the shoe or boot if the cover is not held adequately in place. In order to assure that the cover is properly secured to the shoe, the present invention provides a positive fastening means between the cover and the sole of the shoe.

These and other objects of the present invention will become apparent from a reading of the following specification, taken in conjunction with the enclosed drawings.

BRIEF DESCRIPTION OF THE PREFERRED EMBODIMENTS

Figure 1B:
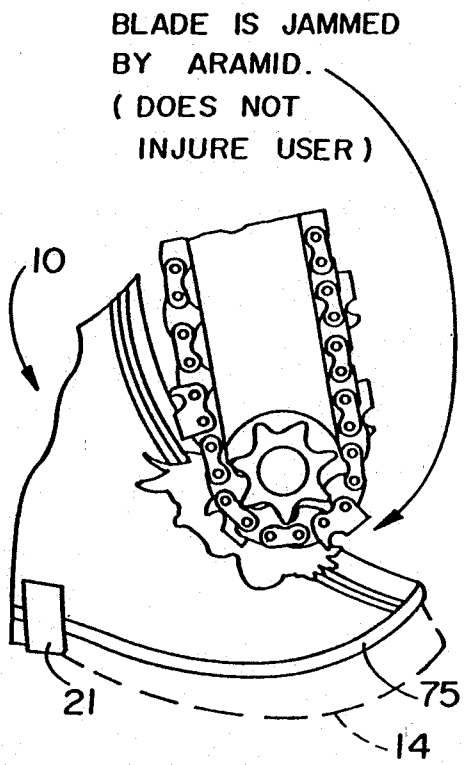
FIG. 1B is a perspective view, in enlarged scale, showing the para aramid fabric jamming the teeth of chainsaw and providing protection to the wearer of the protective cover of the present invention.
Figure 1A:
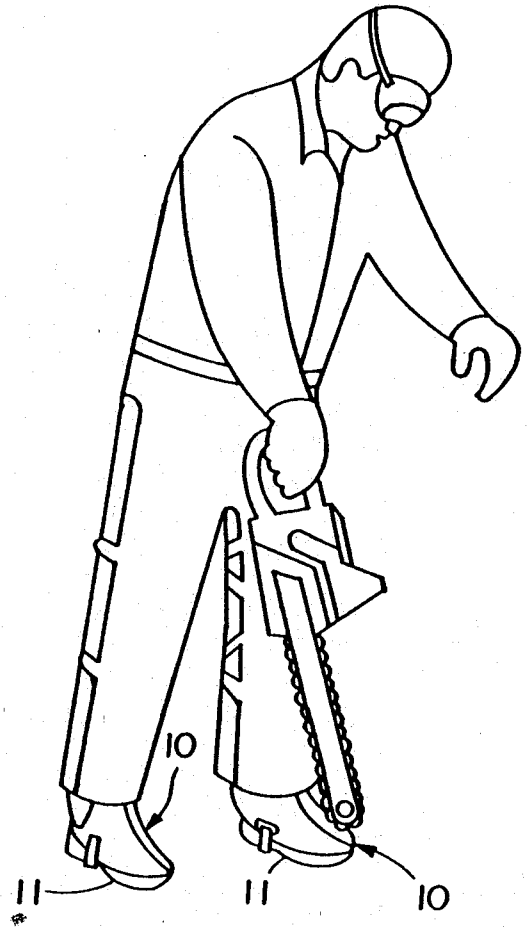
FIG. 1A is a perspective view of the operating chainsaw accidentally contacting the protective cover of the present invention.
Figure 1:
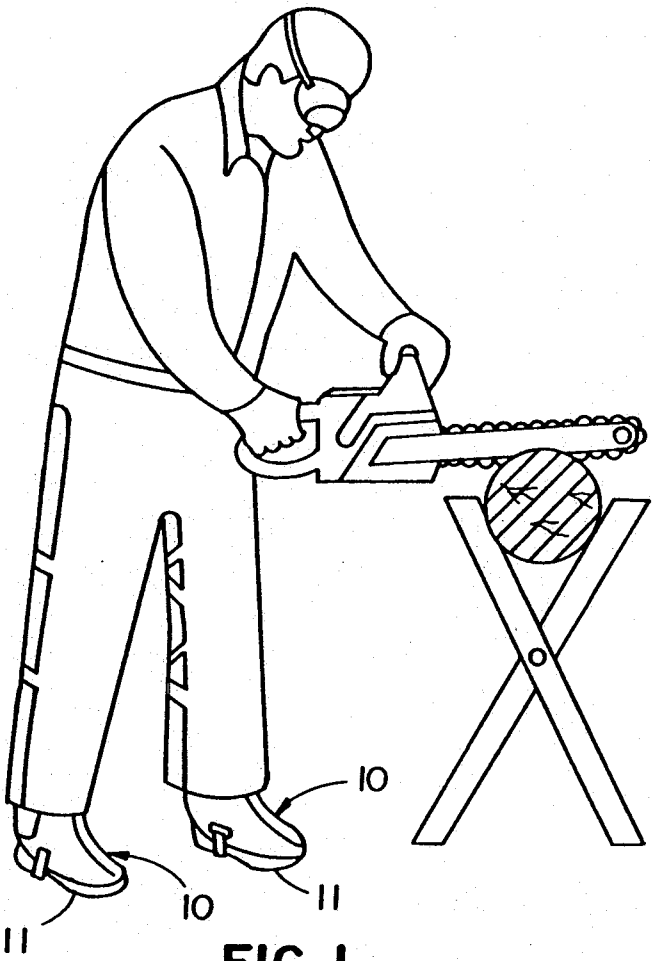
FIG. 1 is a perspective view of a user holding a chainsaw and wearing protective chaps and the protective cover for shoes of the present invention.

Referring to FIGS. 1–8 the protective cover 10 is shown as it is worn on a typical shoe or boot 11. The protective cover 1o is a unitary flexible multiple layer fabric body which is substantially flat and has a central forwardly-disposed upwardly projecting portion. When the body is folded, it is contoured as a curve to conform to the instep 15 of the shoe 11. When so folded, the protective cover 10 extends in a gaiter-like manner over the ankle of the wearer and extends from the instep of the shoe, on both the outer side and the inner side of the shoe, downwardly to the sole plane (side of the sole) 14 of the shoe 11 and backwardly to the back 13 of the shoe 11. A strap 21 is attached to the first side of the cover 19 and is extended around the arch 12 of the shoe 11. FIGS. IA and IB show the use of the protective cover 10 in a typical accident in which a chainsaw contacts the protective cover 10. The teeth of the chainsaw are jammed by the lining means 32 and the cutting action of the chainsaw is stopped.

Figure 3:
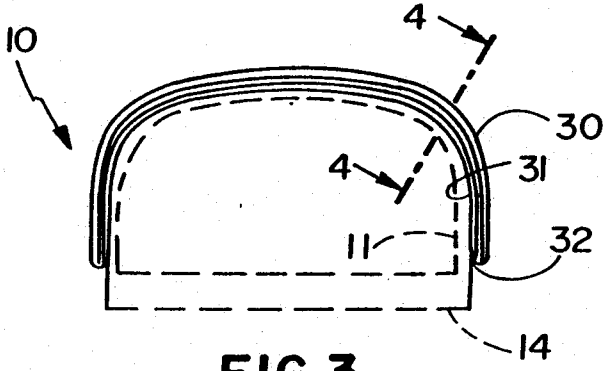
FIG. 3 is a cross-sectional view of the protective cover taken along lines 3—3 of FIG. 2.
Figure 4:
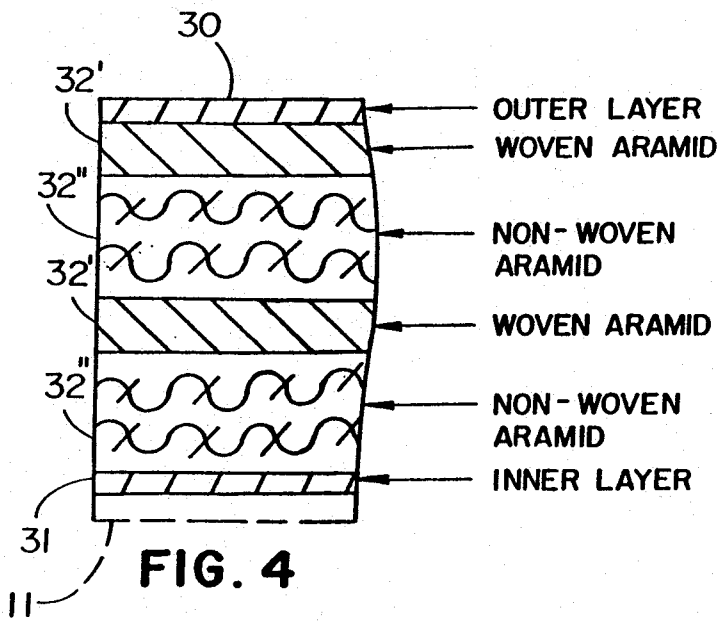
FIG. 4 is a cross-sectional view of the protective cover taken along lines 4—4 of FIG. 3.
Figure 2:
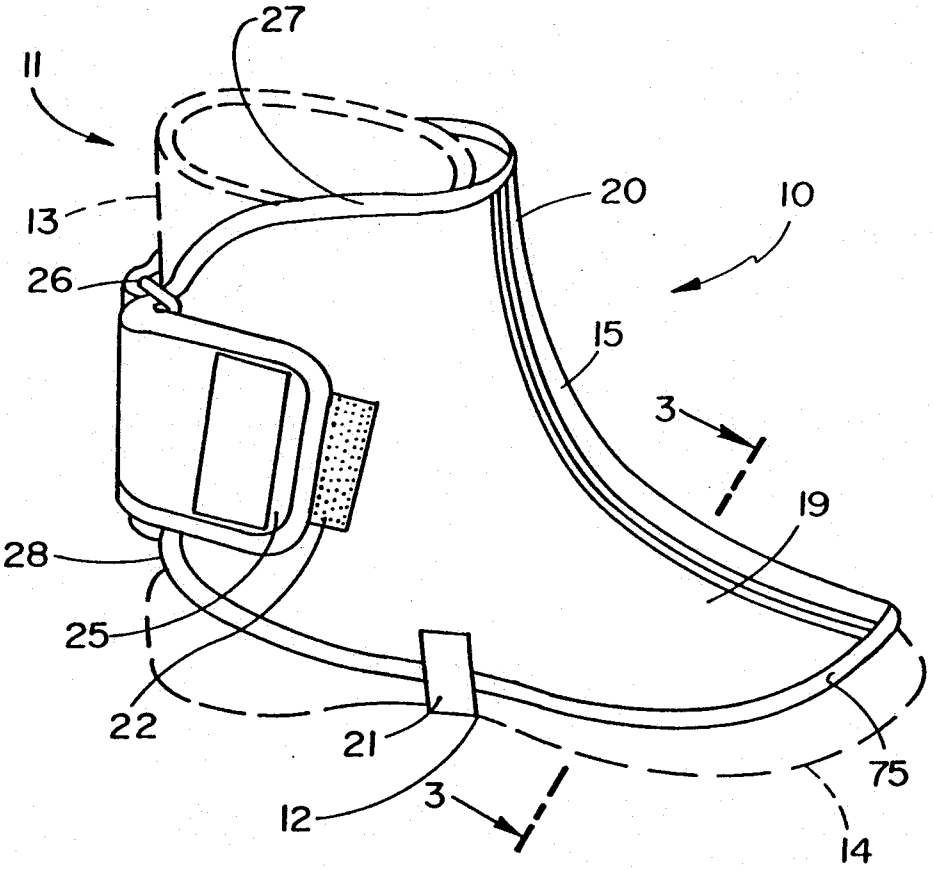
FIG. 2 is a perspective view of one embodiment of the protective cover of the present invention showing the means of wearing the cover on a boot.

As shown in FIG. 3, the protective 10 protects the entire upper surface of the shoe 11. FIG. 4 shows that the multiple layer body has an outer layer 30 and an inner layer 31 with lining means 32 therebetween. The layers 30, 31 may be nylon or other suitable fabric which The lining means must be formed from a high modulus having a tensile modulus in excess of approximately 20 g/d Para-aramid fiber sold by E. I. DuPont de Nemours and Co., under the registered trademark "Keylar" has been used satisfactorily as the lining means 32. Another satisfactory lining means 32 is a high modulus polyethylene/polypropylene composite fiber which is sold by DSM High Performance Fibers BV, the Netherlands under the Registered Trademark "DYNEEMA" ® and sold by Allied Corporation, Petersburg, Virginia under the Registered Trademark "SPECTRA" ®.

In a preferred embodiment, the paraaramid lining 32 comprises both woven 32' and non-woven 32" fabric. At least one layer of woven para aramid 32' is placed adjacent to at least one layer of non-woven para aramid 32". In an especially preferred embodiment two (2) woven para aramid 32' layers are in an alternating pattern with two (2) non-woven para aramid 32" layers. The combination of woven and non-woven lining material is preferred because the non-woven layers is stiffer and offers a more supportive base for the woven layers. This support tends to hold the woven layers in a more structured manner when engaged by the chainsaw blade and permits filaments of the woven layer to be more readily disengaged from the woven layers. The filaments cause the chainsaw blade to join.

Figure 6:
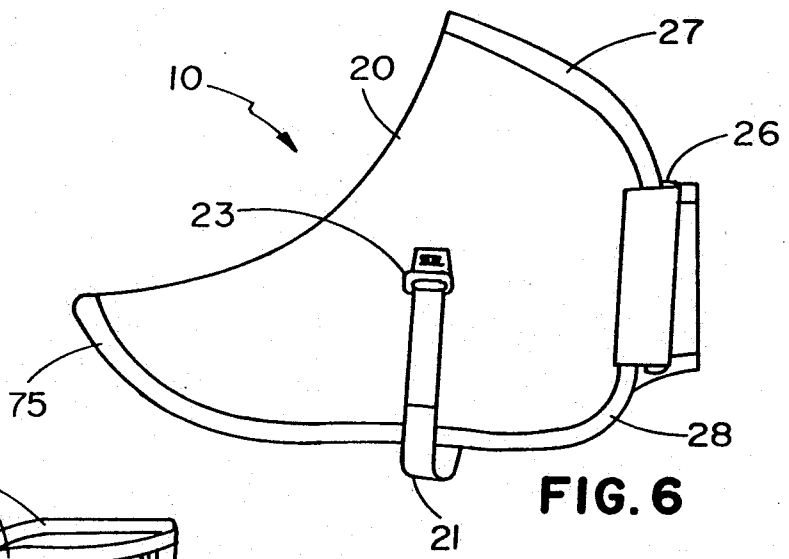
FIG. 6 is a left side elevational view of FIG. 2 showing the strap secured to the side of the protective cover and extending under the arch of the boot to secure the protective cover.
Figure 5:
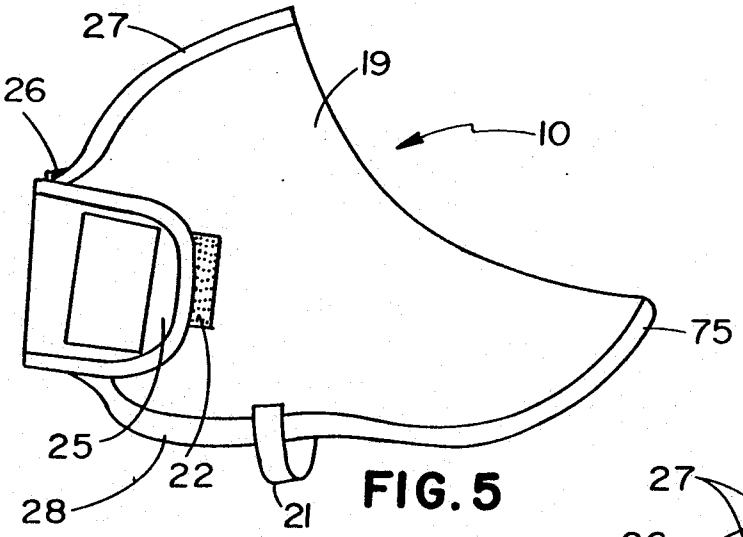
FIG. 5 is a right side elevational view of FIG. 2 showing the tab extending around the back of the boot to secure the cover and also showing the strap extending under the arch of the boot.
Figure 8:
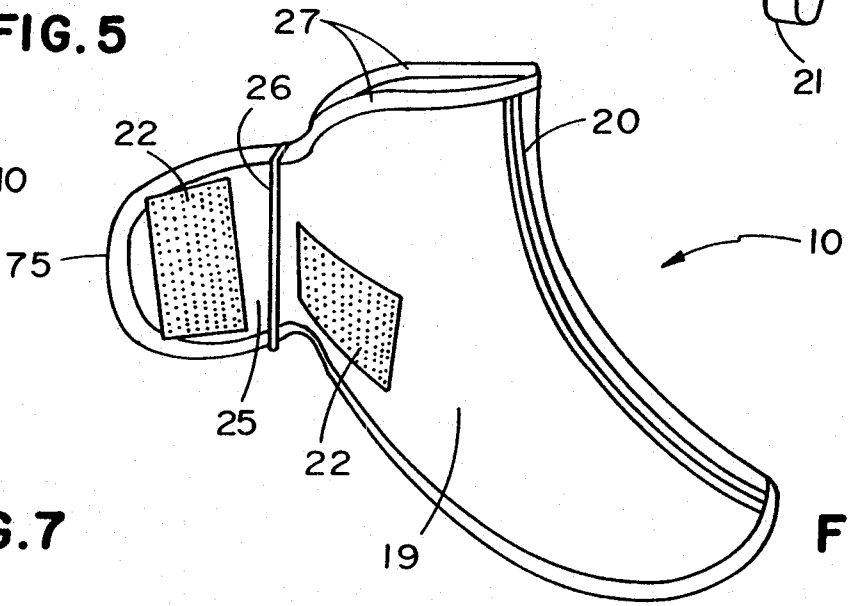
FIG. 8 is a perspective view of the protective cover of the present invention showing the tab drawn through the rigid loop such that the tab may be folded back to secure the cover around the back of the boot and be held in place by the hook and loop fasteners.
Figure 7:
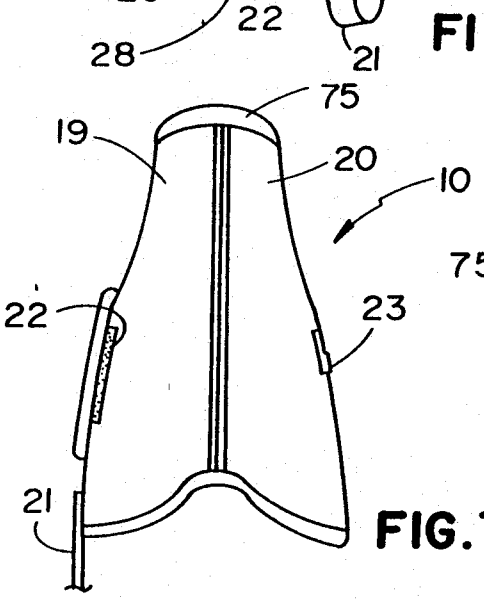
FIG. 7 is a front view of the protective cover of the present invention showing the strap secured to the side of the cover and extending from the side of the cover.

As seen in FIGS. 6–7, an eyelet 23 having an opening therein is attached to the second side of the cover 20. The end of the strap 21 is inserted through the opening in the eyelet 23 and folded back on itself and adjustably held thereon by hook and loop fasteners on the end of the strap and on the body of the strap. Alternately, the eyelet 23 may be omitted and the strap 21 may be fastened directly to the second side of the cover 20 by means of hook and loop fasteners, buckles, snap or other suitable fasteners. This means of securing the cover 10 around the arch 12 of the shoe 11 permits adjustment to accommodate shoes of varying sizes and also is a simple and rapid means for securing the cover 10 to the shoe 11. Further, by securing the cover 10 around the arch 12 of the shoe 11, the cover 10 conforms to the shoe 11 to provide the needed protection and also permits wearing of the cover 10 under all types of walking and working conditions.

Each side 19-20 of the protective cover 10 has a respective upper portion and a respective lower portion. As seen in FIGS. 2, 5, 6 and 8, the upper portion of each side 19,20 has a segment 27 which curves downwardly toward the rear of the cover 10 and the lower portion of each side 19, 20 has a segment 28 which curves upwardly toward the rear of the cover 10. The first side of the cover 19 has a tab 25 extending outwardly therefrom (FIGS. 2, 5, 6 and 8). When the cover 10 is folded and placed over the shoe 11, the tab 25 extends outwardly beyond the back of the shoe 13. The tab 25 is extended across the second opening 18 and is inserted into a bail or loop means 26 attached to the second side of the cover 20. The tab 25 is then returned approximately 180° to the first side of the cover 19, thereby closing the second opening 18 in the cover 10 and securing the cover 10 about the back 13 of the shoe 11. The tab 25 is secured to the first side of the cover 19, preferably by means of hook and loop fasteners 22. Alternate releasable means such as buckles or snap fasteners and straps may be used for securing the cover 10 around the back 13 of the shoe 11.

Figure 9:
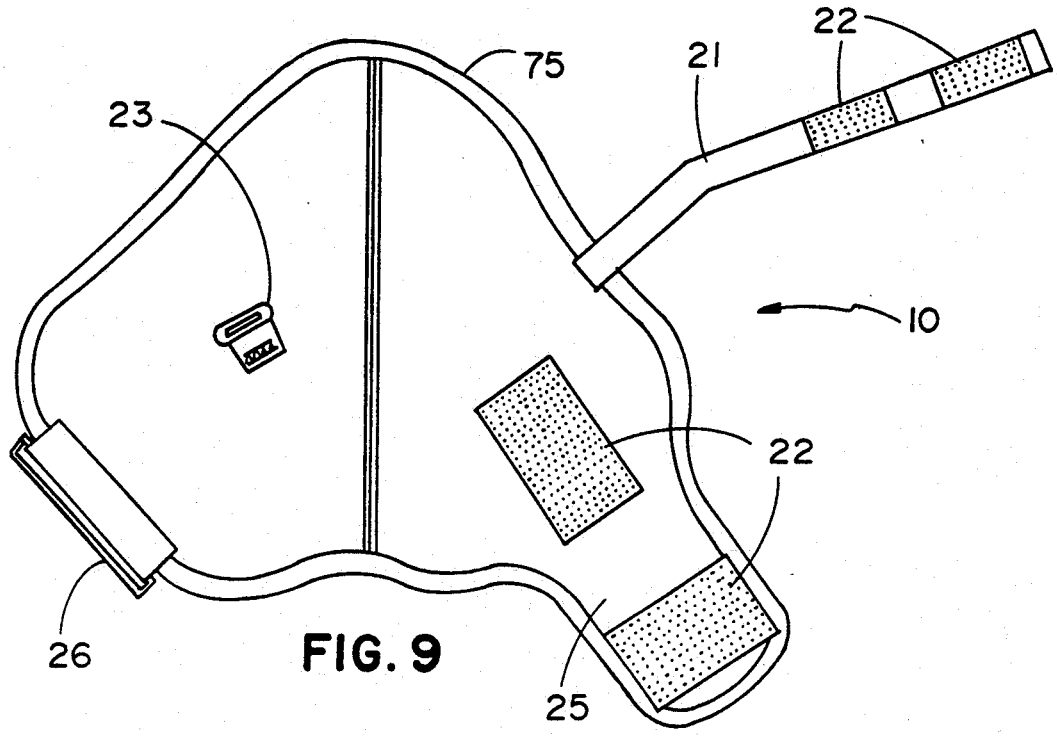
FIG. 9 is a top plan view of the protective cover of the present invention, wherein the cover has been laid open and flattened out showing the tab, the rigid loop, the strap and the hook and loop fasteners.
Figure 10:
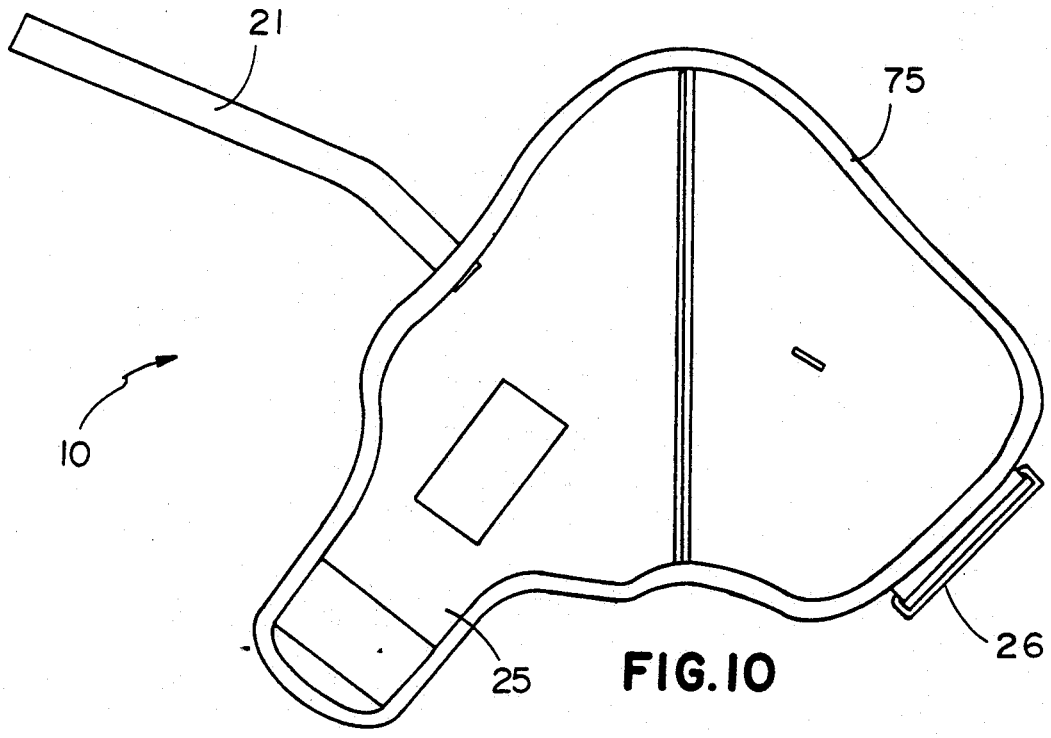
FIG. 10 is a bottom plan view of the protective cover of the present invention, wherein the cover has been laid open and flattened out showing the tab and the strap extending outwardly from the body.

As shown in FIGS. 9 and 10, the cover 10 is a body having a first portion and a second portion which are joined together. Preferably, the portions are sewn together.

Figure 11:
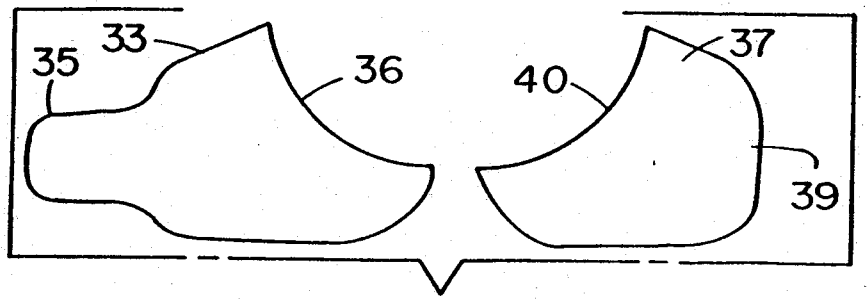
FIG. 11 is a top plan view showing the outside of the first section and the outside of the second section prior to joining.
Figure 14:
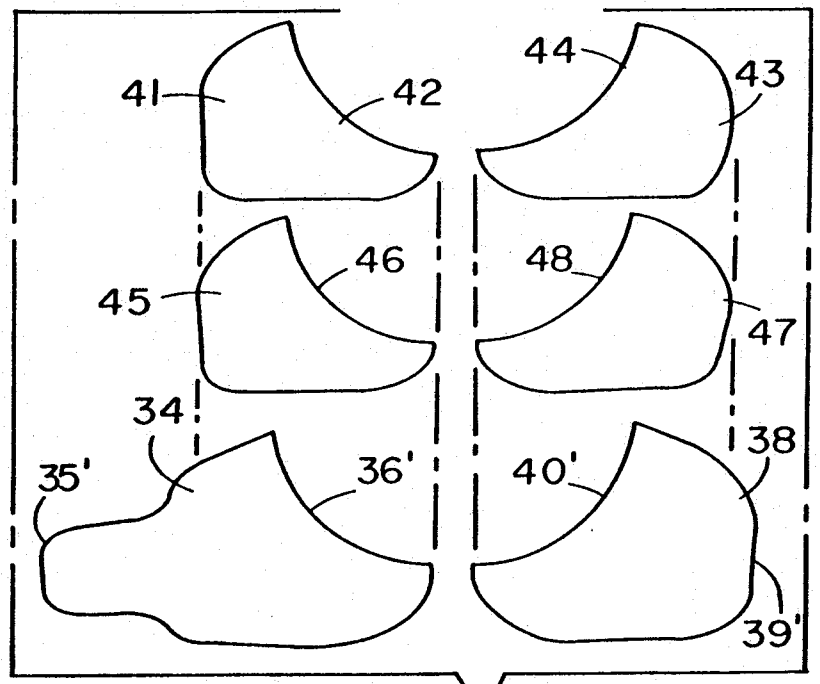
FIG. 14 is an exploded top plan view showing the inside of the first section, non-woven para aramid lining and woven para aramid lining to be placed thereon, and the inside of the second section, non-woven para aramid lining and woven para aramid lining to be placed thereon in position prior to joining of the components.

A method for fabricating a protective cover 10 for a shoe 11, boot and the like includes the steps of providing a sheet of fabric and cutting two patterns from the fabric sheet. An outside pattern 33 is cut for the first section of the shoe cover and an inside pattern 34 is cut for the first section of the shoe cover 10. Each pattern has a respective tab edge 35, 35' and an opposite respective concave edge 36, 36' (FIGS. 11 and 14). The fabric may be nylon or other material with sufficient durability. Two additional patterns are cut from the fabric sheet. An outside pattern 37 is cut for the second section of the shoe cover and an inside pattern 38 is cut for the second section of the shoe cover 10. Each pattern has a respective back edge 39, 39, and an opposite respective concave edge 40, 41, A sheet of woven para aramid fabric is provided. Referring to FIG. 14, at least one pattern 41 is cut from the woven para aramid fabric to provide a lining for the first section of the shoe cover 10. Each pattern has a concave edge 42. At least one pattern 43 is cut from the woven para aramid fabric to provide a lining for the second section of the shoe cover 10. Each pattern has a concave edge 44. A sheet of non-woven para aramid fabric is provided. At least one pattern 45 is cut from the non-woven para aramid fabric to provide additional lining for the first section of the shoe cover. Each pattern has a concave edge 46. At least one pattern 47 is cut from the non-woven para aramid fabric to provide additional lining for the second section of the shoe cover. Each pattern has a concave edge 48.

Figure 13:
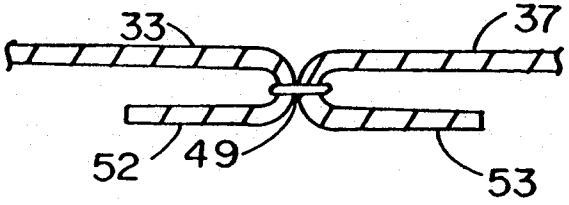
FIG. 13 is a cross-sectional view, enlarged for the sake of clarity, taken across the lines 13—13 of FIG. 12.
Figure 12A:
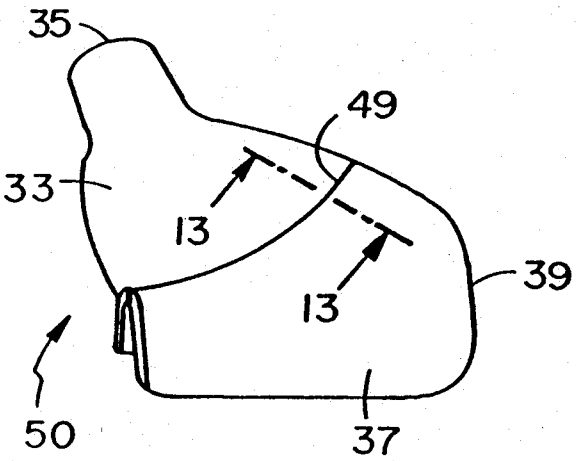
FIG. 12A is a perspective view showing the sections of FIG. 11 sewn together along their respective concave edges.
Figure 12:
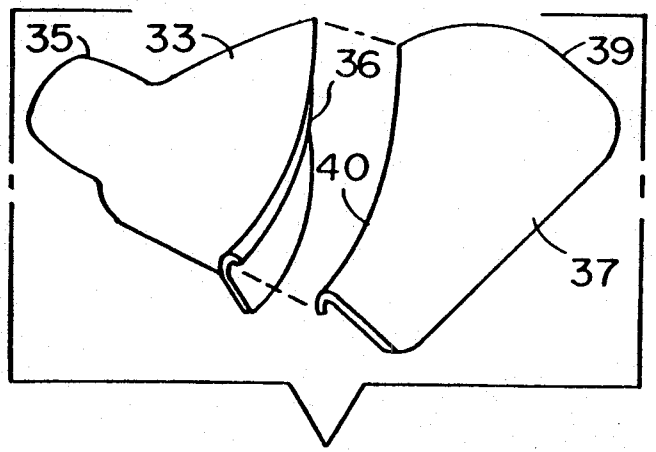
FIG. 12 is a perspective view showing the joining of the sections of FIG. 11 along their respective concave edges.

Referring to FIG. 12, the respective concave edge 36 of the outside of the first section 33 is butted with the respective concave edge 40 of the outside of the second section 37 and said concave edges 36, 40 are sewn together to form a seam 49 (FIG. 12A). When the sewn sections are opened and laid flat, a first portion 50 is formed having an upper surface and a lower surface. A selvage edge 52, 53 for each respective section is formed (FIG. 13), the selvage edges extending from the lower surface. The selvage edges 52, 53 are folded away from the seam such that each selvage edge 52, 53 is parallel to each respective section 33, 37.

As shown in FIG. 14, the pattern for the non-woven para aramid fabric for the first section 45 and the pattern for the woven para aramid fabric for the first section 41 are placed on the pattern for the fabric sheet for the inside of the first section 34 such that the respective concave edges 42, 46, 36' are substantially coincidental. The pattern for the non-woven para aramid fabric for the second section 47 and the pattern for the woven para aramid fabric for the second section 43 are placed on the pattern for the fabric sheet of the inside of the second section 38 such that the respective concave edges 48, 44, 40' are substantially coincidental.

Figure 15:
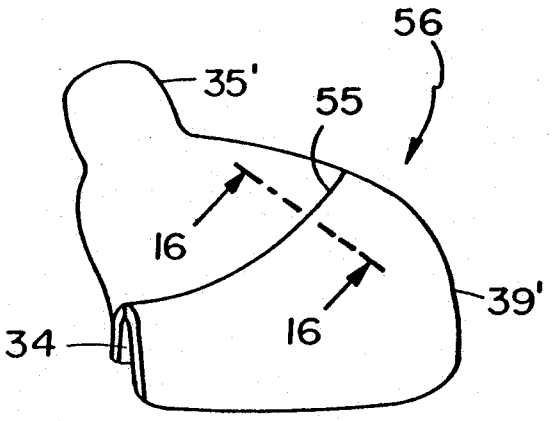
FIG. 15 is a perspective view showing the components of FIG. 14 sewn together along their respective concave edges.

Referring to FIG. 15 the respective concave edges of the inside of the first section 36 and the woven para aramid lining 42 and the non-woven para aramid lining 46 are butted with the respective concave edges of the inside of the second section 40, and the woven para aramid lining 44 and the non-woven para aramid lining 48 in a manner similar to that described above (and shown in FIGS. 12 and 12A). The concave edges 36,, 42, 46, 40', 44, 48 are sewn together to form a seam 55 which extends through the woven para aramid lining 41, the non-woven para aramid lining 45, the inside of the first section of fabric 34, and through the inside of the second section of fabric 38, the non-woven para aramid lining 47 and the woven para aramid lining 43. When the sewn sections are opened and laid flat a second portion 56 is formed.

Figure 16:
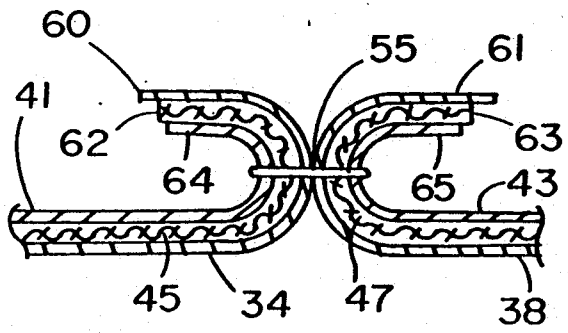
FIG. 16 is a cross-sectional view, enlarged for the sake of clarity, taken across the lines 16—16 of FIG. 15.

As shown in FIG. 16, a respective selvage edge 60, 62, 64, 61, 63 and 65 is formed on each of the inside of the first section 34, the non-woven para aramid lining 45 and the woven para aramid lining 41, the inside of the second section 38, the non-woven para aramid lining 43 and the woven para aramid lining 65. The respective selvage edges 60, 62, 64, 61, 63, 65 extend from the seam 55, the selvage edges being folded away from the seam 55 such that each selvage edges 60, 62 and 64 are parallel to the first section 34 and selvage edges 61, 63 and 65 are parallel to the second section 38.

Figure 17:
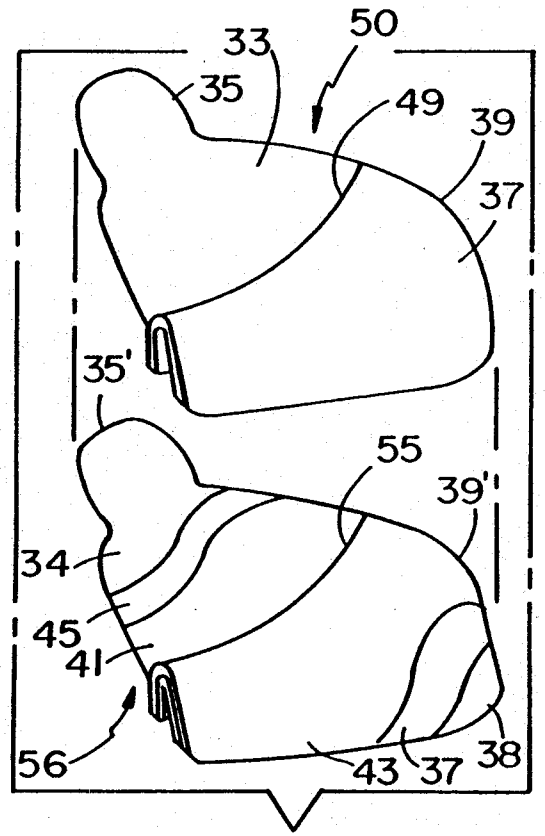
FIG. 17 is a perspective view showing the assembling of the joined outside sections of FIG. 12A with the joined inside sections of FIG. 15 and further showing a partial cut-away view to illustrate the layers comprising the body.

As shown in FIG. 17, the first portion 50 is placed adjacent to the second portion 56 such that the non-woven para aramid lining 45, 47 and the woven para aramid lining 41, 43 are disposed between the first portion 50 and the second portion 56, in a manner such that the seams 49, 55 of the sewn together sections are substantially coincidental. The tab edge of the inside of the first section 35' is substantially coincidental with the tab edge of the outside of the first section 35, and the back edge of the inside of the second section 39' is substantially coincidental with the back edge of the outside of the second section 39.

Figure 18:
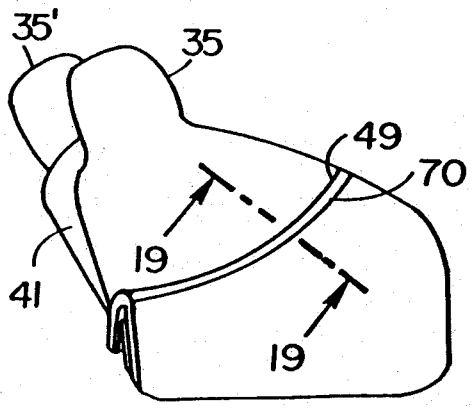
FIG. 18 is a perspective view showing the respective inside first section sewn together with the respective outside first section.

As shown in FIG. 18, the outside of the second section 37 of the first portion 50, is sewn to the inside of the second section 38 of the second portion 56 by forming a seam 70 substantially parallel and adjacent to the seams 49, 55 which form the respective first portion 50 and second portion 56.

Figure 19:
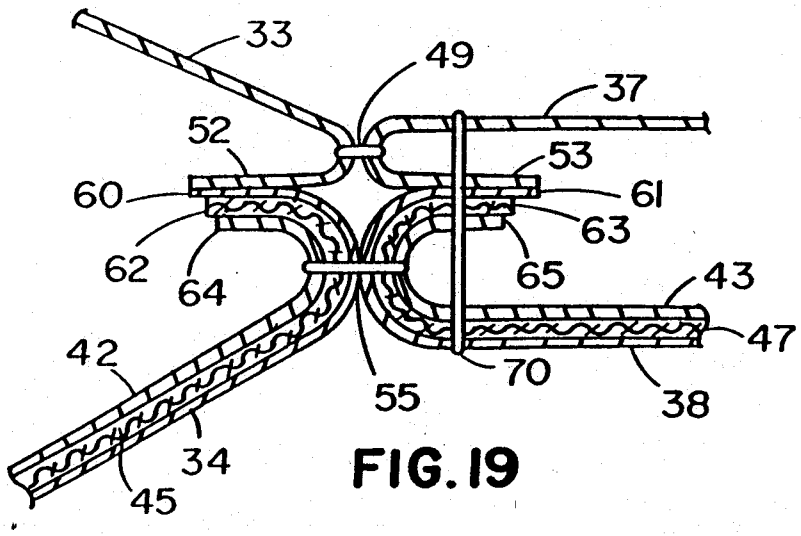
FIG. 19 is a cross-sectional view, enlarged for the sake of clarity, taken across the lines 19—19 of FIG. 18.

In this manner, (FIG. 19) the seam between the outside of the second section 37 (on the first portion 50) and the inside of the second section 38 (in the second portion 56) intercepts, in sequence, the outside of the second section 37, the selvage edge of the outside of the second section 53, the selvage edge of the inside of the second section 61, the selvage edge of the non-woven para aramid lining 63, the selvage edge of the woven para aramid lining 65, the woven para aramid lining 43, the non-woven para aramid lining 47 and the inside of the second section 38.

Figure 20:
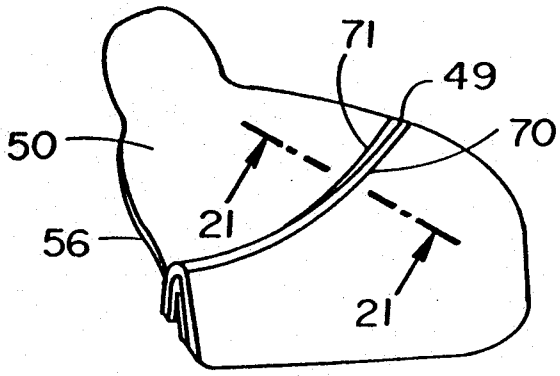
FIG. 20 is a perspective view of the protective cover of FIG. 18 showing the respective inside second section sewn together with the respective outside second section.
Figure 21:
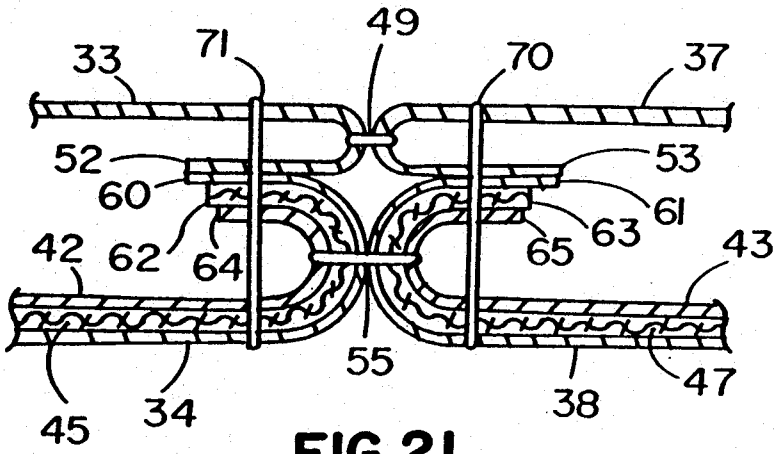
FIG. 21 is a cross-sectional view, enlarged for the sake of clarity, taken across the lines 21—21 of FIG. 20.

Referring to FIGS. 20 and 21, the outside of the first section 33 of the first portion 50 is sewn to the inside of the first section 34 of the second portion 56 by forming a seam 71 substantially parallel to, and adjacent to, the seams 49, 55 which form the respective first portion 50 and second portion 56. In this manner, the seam 71 between the outside of the first section 33 (on the first portion 50) and the inside of the first section 34 (on the second portion 56) intercepts, in sequence, the outside of the first section 33, the selvage edge of the outside of the first section 52, the selvage edge of the inside of the first section 60, the selvage edge of the non-woven para aramid lining 62, the selvage edge of the woven para aramid lining 45 and the inside of the first section 34.

Figure 22:
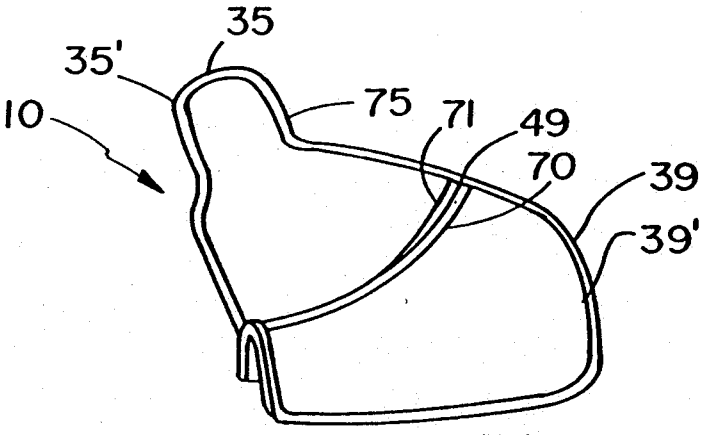
FIG. 22 is a perspective view of the protective cover of FIG. 20 showing a bias binding sewn around the protective cover.

A bias binding 75 is provided and sewn around the joined together first portion 50 and second portion 56 to overlap the tab edges 35, 35' and the back edges 39, 39, of the respective sections (FIG. 22).

The method of sewing the inside sections 33, 37 together to have the seam 55 intercept the fabric and para aramid patterns and to form selvage edges, assures that the para aramid linings 43, 47, 41, 45 are butted together and there are no open spaces between the para aramid linings. Thus, sharp edges'such as teeth on a chainsaw, are prevented from penetrating the sections. Further, the method of sewing the first portion 50 to the second portion 56 by having seams 70, 71 sewn substantially at right angles to the seams 49, 55 connecting the first and second sections, further assures the integrity of the cover 10. It also further assures the placement of the para aramid layers to prevent penetration of sharp edges through the protective cover 10.

Figure 23:
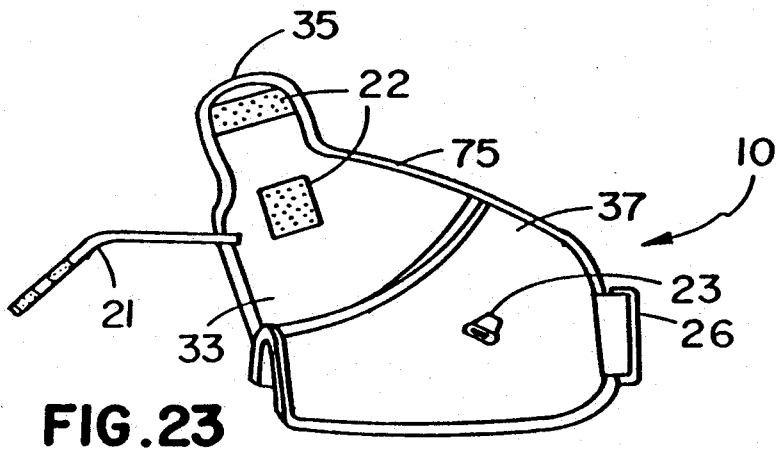
FIG. 23 is a perspective view of the protective cover of FIG. 22 showing the addition of the strap, eyelet, hook and loop fasteners and rigid loop.

As shown in FIG. 23 a strap 21 is provided having a one end and an other end. The one end of the strap 21 is attached to the outside of the first section 33 on the first portion of the shoe cover 10. A means 23 is provided for removably attaching the other end of the strap 21 to the outside of the second section 37 on the first portion of the shoe cover 10. In a preferred embodiment, the means is an eyelet 23 attached to the outside 37 of the second section through which the other end of the strap 21 may be drawn and secured. It would be apparent to one skilled in the art to use a buckle attached to outside 37 of the second section or hook and loop fasteners on the strap and on the cover 10 as means for attaching the strap.

The above method is directed toward the use of para aramid lining means 32. In all instances, high modulus lining means such as polyethylene/polypropylene composite fibers can be used.

Also shown in FIG. 23 are hook and loop fasteners 22 attached near the tab edge 35 of the outside 33 of the first section. These fasteners 22 engage the tab edge 35 after it is inserted through a bail 26 secured to the second section, and folded back onto the outside section. This embodiment is used to secure the back opening 18 of the cover 10 around the shoe. It would be apparent to persons skilled in the art to use a buckle or other means to secure the back opening 18.

In an alternate embodiment, the lining between the first portion 50 and the second portion 56 is a plurality of alternating woven para aramid linings and non-woven para aramid linings. The seam 55 would intercept all of these linings in addition to the inside of the first section 34 and the inside of the second section 38. Further, the seams 70 and 71 would intercept the selvage edges of each respective lining.

The figures show a pattern for the right foot. In order to make a cover for the left foot, the pattern as shown would be cut as a mirror image of those shown as is well known to those skilled in the art. The method of sewing the patterns and the linings are the same as shown in the figures. The means for attaching the strap 21 and the closure means for the opening of the back 11 of the cover would be the same as with the right foot but would be fabricated accordingly.

In a preferred embodiment the side portions 19, 20 have a maximum height as determined by the size of the gaiter to ensure coverage of the boot and hence, protection for the ankle. The upper portions of the side portions 19, 20 have segments 27 which curve downwardly to the tab 25 and the lower portions of the side portions 19, 20 have segments 28 which curve upwardly to the tab 25. In this manner the tab 25 secures the cover 10 about the rear portion of the shoe or boot and there are no segments of the side portions 19, 20 which are available to be ensnared by underbrush or other projecting objects as the wearer of the cover 10 is walking on a job site. The outer periphery of the cover 10 is smoothly contoured to conform to the foot of the wearer. The tab 25 has a height which extends substantially between the upwardly curved portions and the downwardly curved portions of the respective sides 19, 20. It has been found that the tab 25 should have a height which is approximately 30–60% of the maximum height of the side portions 19, 20 in order to assure the desired closure of the gaiter 10. It is particularly preferred that the height of the tab 25 be approximately 45% of the maximum height of the side portions 19, 20.

Figure 25:
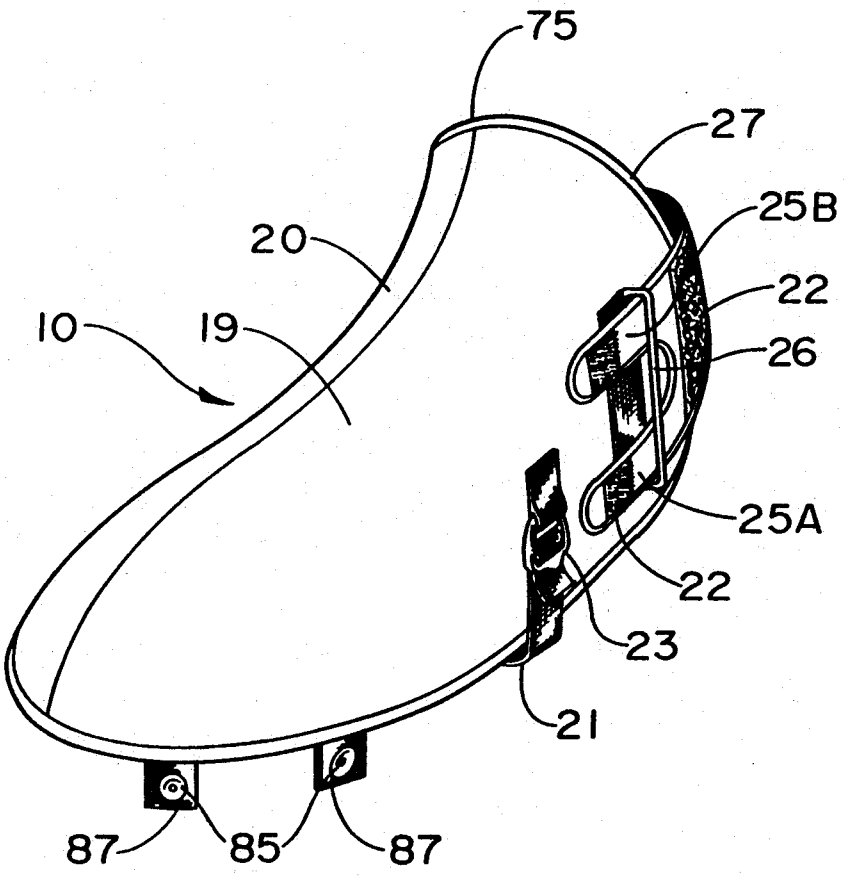
FIG. 25 is a perspective view of a further embodiment of the protective cover of the present invention showing two tabs and one bail to secure the cover around the back of the boot.
Figure 24:
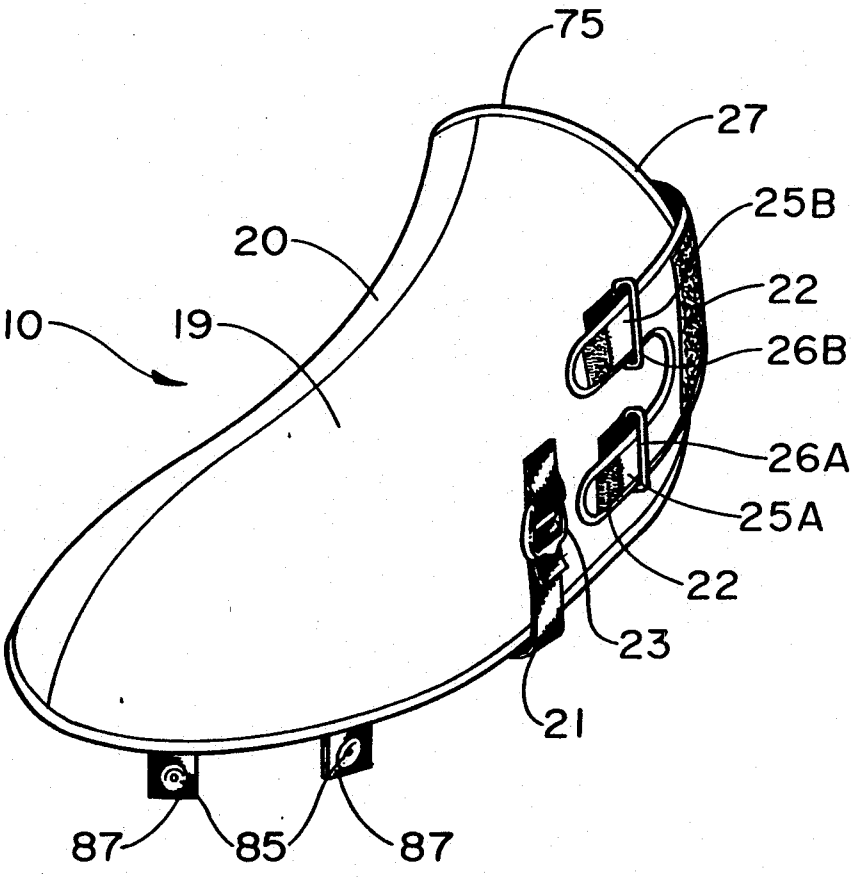
FIG. 24 is a perspective view of another embodiment of the protective cover of the present invention showing two tabs and two bails to secure the cover around the back of the boot.

A single tab 25 is preferred since donning and removal of the gaiter 10 is simplified by the wearer's needing only to connect or disconnect the single tab 25. This can be performed by one hand of the wearer. However, the gaiter 10 may be secured about the back of the shoe by a plurality of tabs 25A, 25B and a plurality of bails 26A, 26B as shown in FIG. 24. A further embodiment as shown in FIG. 25 has a plurality of tabs 25A, 25B and a single bail 26. The tabs 25A, 25B secure the gaiter 10 near the downwardly curving segment 27 of the side portions 19, 20 and near the upwardly curving segments 28 of the side portions 19, 20 respectively.

These embodiments require that the wearer connect and disconnect two tabs 25A, 25B in order to place the gaiter 10 on the boot or to remove the gaiter 10 from the boot.

Another feature of the tab 25, 25A, 25B is that, due to the tab's being returned about the bail 26, the fastening means is not directly stressed by the engagement of the chainsaw. The tab 25 after passing through the bail 26 and returning to the side portion 19 is fastened to the side portion 19, preferably by mating hook and loop fasteners 22 for simplicity of use by the wearer, although other fastening means may be used. Each fastener has a respective separate hook portion and loop portion. The hook portion may be on the tab 25 or on the side portion 19 with the cooperating loop portion o the corresponding side portion 19 or tab 25 respectively. When the protective cover 10 is stressed, the forces are directed against the tab 25, 25A, 25B as it is wrapped about the bail 26. The tab 25, 25A, 25B is pulled in a direction substantially parallel to the side portion 19 of the cover 10 and shear forces are directed against the hook and loop fasteners 22. According to product information provided by 3M Industrial Specialties Division, the suppliers of a commercially available hook and loop type fastener, the sheer strength is seven (7) to eight (8) times greater than the lengthwise peel strength of the fastener. Typically, the hook and loop fasteners are used in the lengthwise peel manner because of the ease of opening and are not used in an application where shear forces are applied. In the present invention a pure tensile load is placed on the backing of the hook and loop fasteners thereby placing the hooks and loops in a pure dynamic sheer character where maximum closure strength is actually obtained. Thus, the longitudinal closure of the present invention about the rear portion of the boot withstands the forces applied by power equipment.

Figure 26:
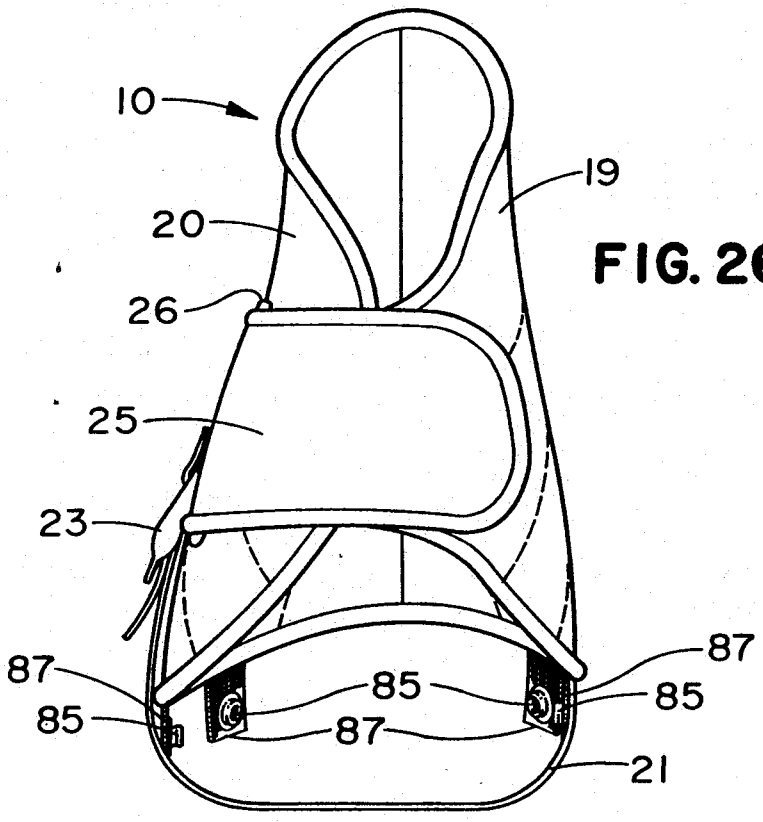
FIG. 26 is a back view of the protective cover of a still further embodiment of the present invention.

Furthermore, the tab 25 is disposed on the cover so that it substantially is across the back of the shoe when the cover 10 is worn (FIG. 26). The fasteners 22 are substantially in the center of the back of the shoe. This structure is preferred because the closed tab 25 is protected from being inadvertently opened by being caught on underbrush and other objects while the wearer is walking. If the edge of the tab 25 were farther toward the toe, on the outer side portion 19, or on the inside of the foot, it would be possible for the tab 25 to be so engaged and opened accidentally.

Figure 27:
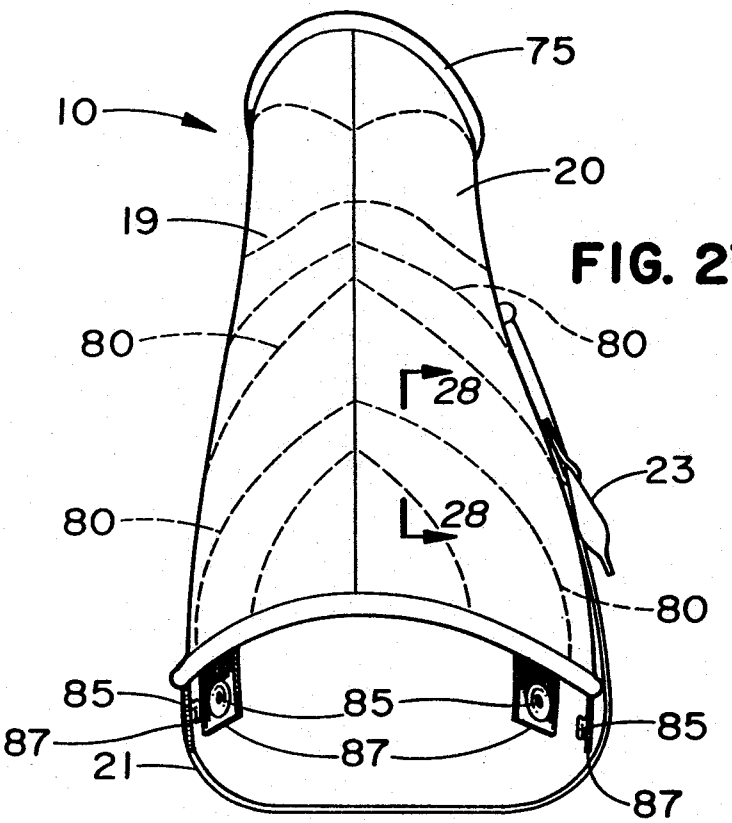
FIG. 27 is a front view of the protective cover of FIG. 26 showing the quilt-like stitching to secure the lining means.
Figure 29:
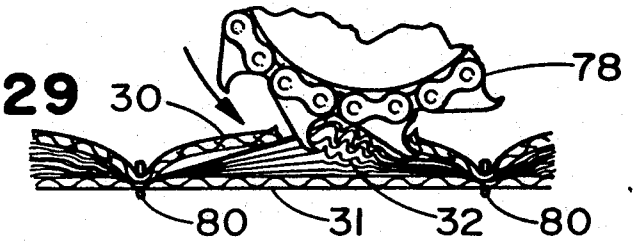
FIG. 29 is the cross-sectional view of FIG. 28 showing a chainsaw blade being jammed by the lining means in the compartment.
Figure 28:
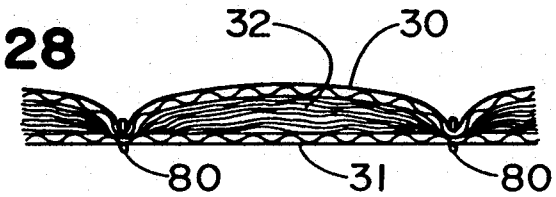
FIG. 28 is a cross-sectional view taken across the lines 28—28 of FIG. 27.

It is also preferred that the multi-layer member of the protective curve 10 be joined together with stitching in a quilt-like pattern 80 to secure the outer layer 30, the inner layer 31 and the lining means 32 therebetween (FIG. 27). In a preferred embodiment, the quilt-like pattern 80 is a plurality of spaced-apart rows of stitching extending radially from the seam formed between the toe portion and the instep by joining of the side portions 19, 20. The rows of stitching extend to the outer periphery of the cover 10 on both sides of the cover 10. The blade 78 of the chainsaw becomes entangled with filaments of the lining means 32 which jam the blade 78 and stop movement of the blade. The quilt-like stitching 80 secures the cover into a plurality of compartments from which the filaments are easily disengaged from the woven lining means 32 within the respective compartment (FIGS. 28–29). In the absence of quilting, the lining means 32 tends to be displaced within the outer layer 30 and the inner layer 31 of the cover, and the lining means 32 bunches so that the filaments are not easily disengaged from the lining means 32.

Figure 30:
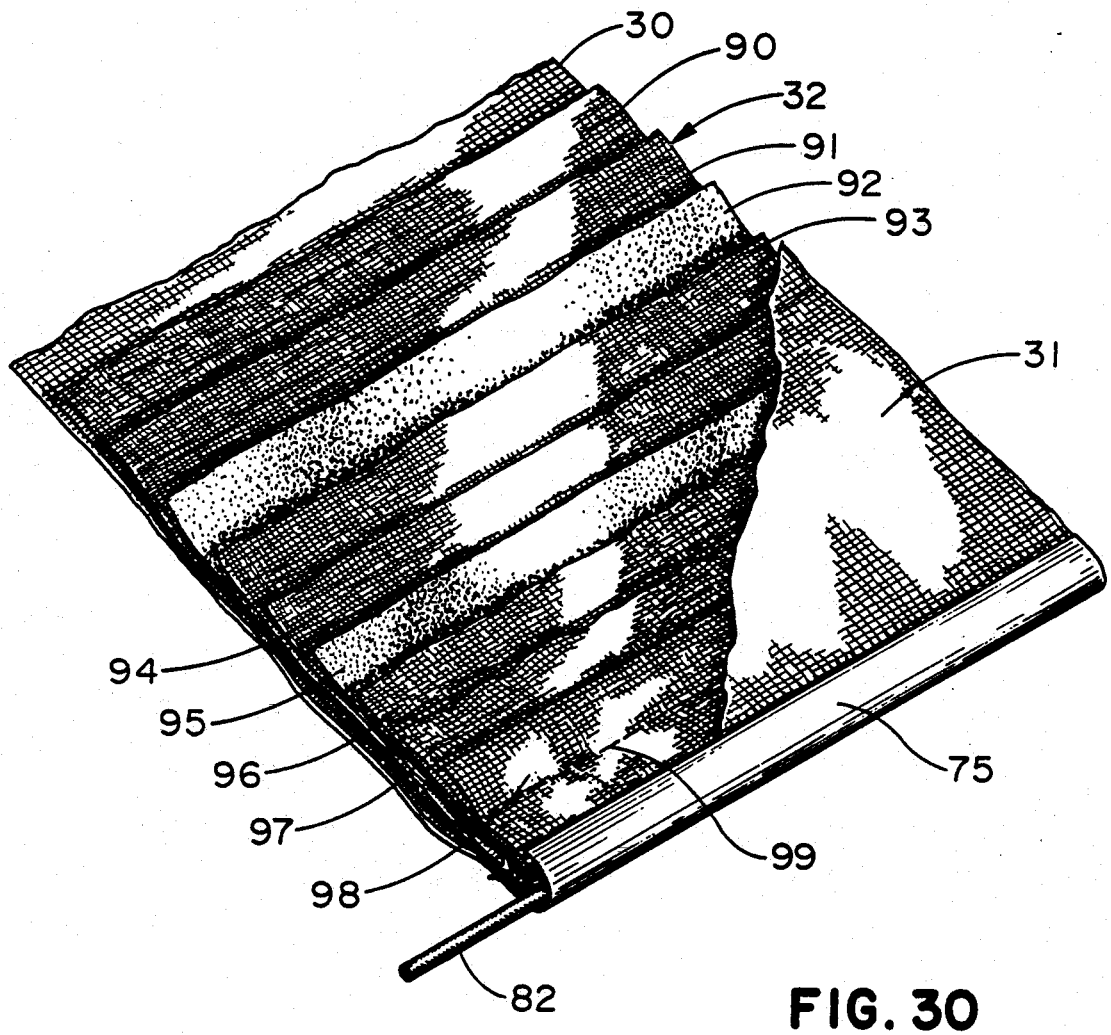
FIG. 30 is a perspective view showing the multiple layers, the folded segment of lining means and a cord of lining means attached to the lower edge of the side portion of the invention of FIG. 26.
Figure 32:
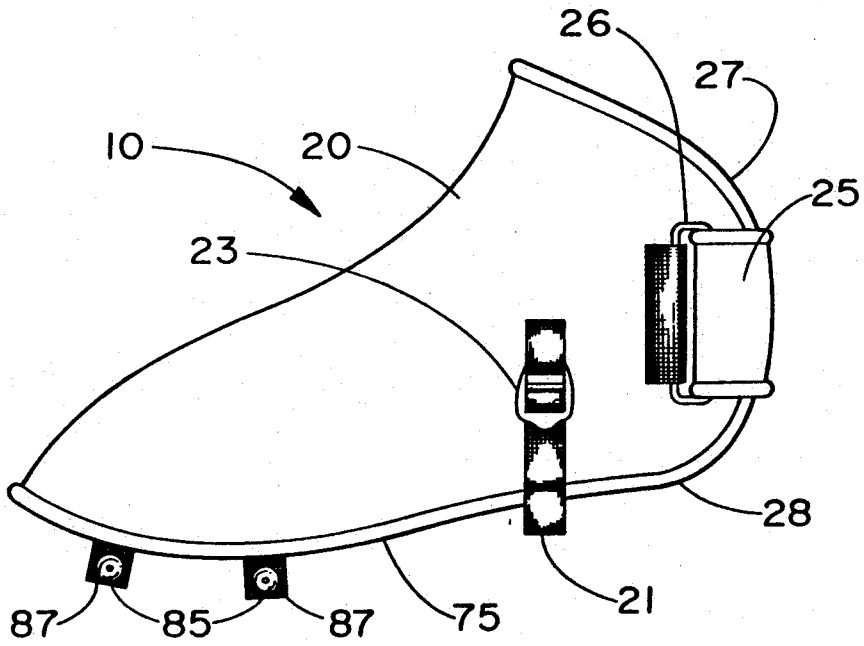
FIG. 32 is a perspective view showing the multiple layers, the folded segment of lining means and a cord of lining means attached to the lower edge of the side portion of the invention of FIG. 26.
Figure 31:
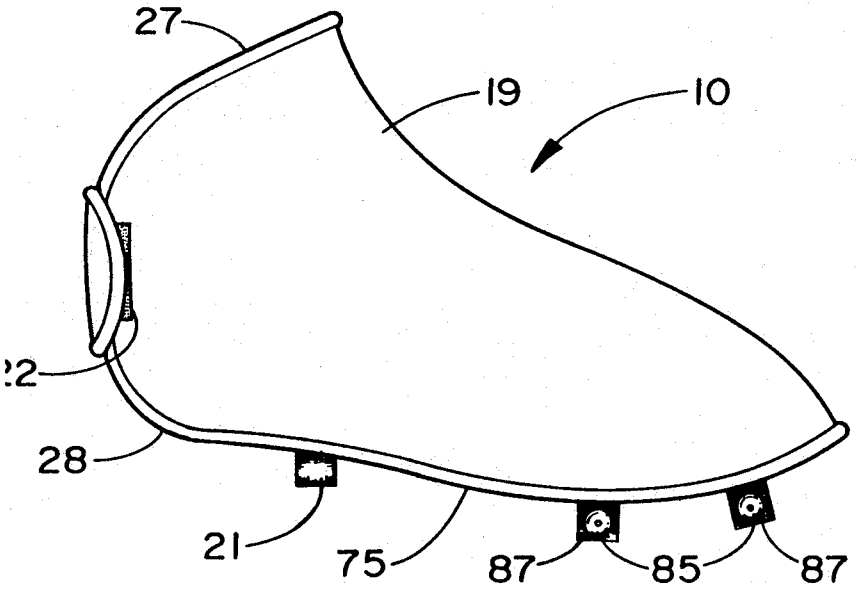
FIG. 31 is a right side elevational view of the protective cover of the invention of FIG. 26 showing spaced-apart flaps having fastening means thereon.

The lining of the present invention is preferably formed from multi layers of para aramid fabric or high modulus polyethylene/polypropylene composite fabric. It is particularly preferred that the lining means 32 be arranged as shown in FIG. 30 with the outer layer 30, two adjacent layers of woven para aramid, fabric 90, 91, one layer of non-woven para aramid fabric 92, two adjacent layers of woven para aramid fabric 93, 94, and layer of non-woven para aramid fabric 95, two adjacent layers of woven para aramid fabric 96, 97 and the inner layer 31. In this manner, eight (8) layers of para aramid fabric are disposed to comprise the lining means 32. However, other embodiments may be made using layers of lining means 32 which are greater than eight (8) or less than eight (8). In order to further restrain the chainsaw blade, a segment of woven para aramid fabric 98 is folded about the respective edge of the lower portion of each layer and is attached thereto, preferably by a thread 99 sewn through all of the layers and through the segment 98 folded about the ends of the layers. The folded segment 98 extends inwardly approximately 2–3 inches from the lower edge of the multiple layers of the lining means 32 toward the instep of the gaiter 10. In this manner, the segment 98 covers the lower edges of all the layers of the lining means and provides additional filaments to jam the blade of the chainsaw and results in further protection against injury by the chainsaw blade.

The most common accident with a chainsaw occurs when the operator of the chainsaw is standing with one foot in an elevated position, the foot resting on a felled tree or workpiece. The chainsaw inadvertently is brought in contact with the elevated foot and the initial point of contact is diagonally across the side of the foot near the sole plane of the boot or across the instep of the boot. In order to provide greater protection from this type of accident, in addition to the folded segment 90, the lower portion of each side 19, 20 of the protective cover 10 is further provided with a cord 82 formed of the lining means 32 attached to the lower edge 83 thereof (FIG. 30). Preferably, the cord 82 is braided however, twist or multiple stands may be used. The cord 82 provides additional protection to the wearer of the gaiter 10, by engaging the blade of the chainsaw along the gaiter 10 directly adjacent to the sole plane 14 of the boot. Thus, lining means 32 is immediately available to bind the chainsaw blade. The cord 82 may be a component of the bias binding 75.

Figure 34:
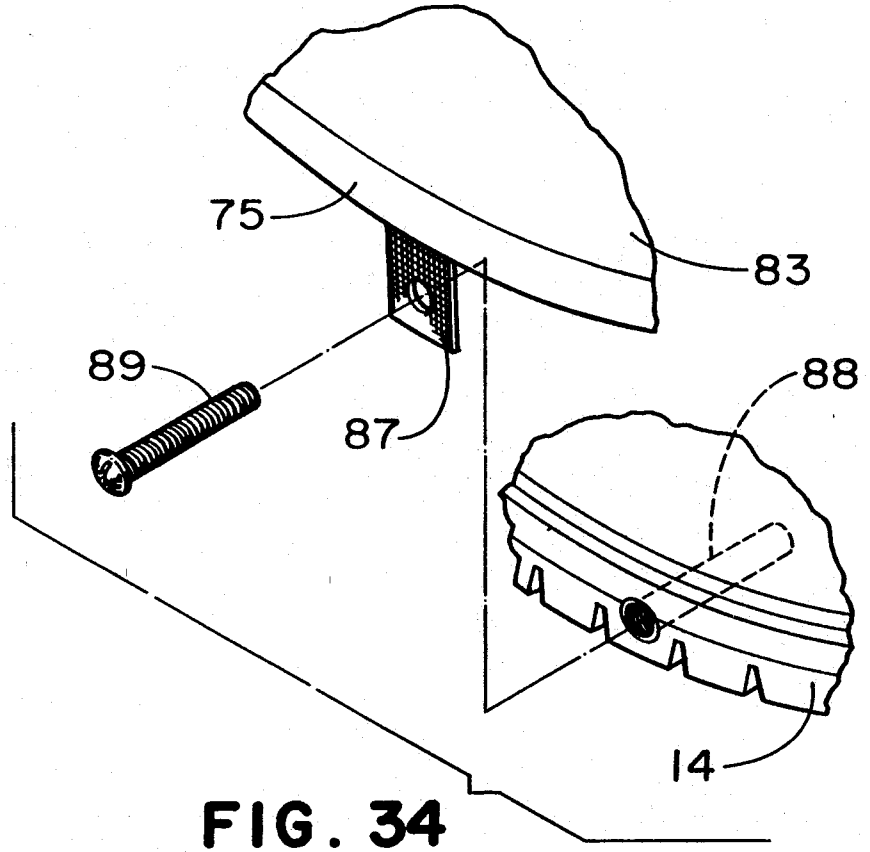
FIG. 34 is an exploded view showing a transverse fastening means to secure the lower edge of the cover of the invention of FIG. 26 to openings in the sole plane of the shoe.
Figure 33:
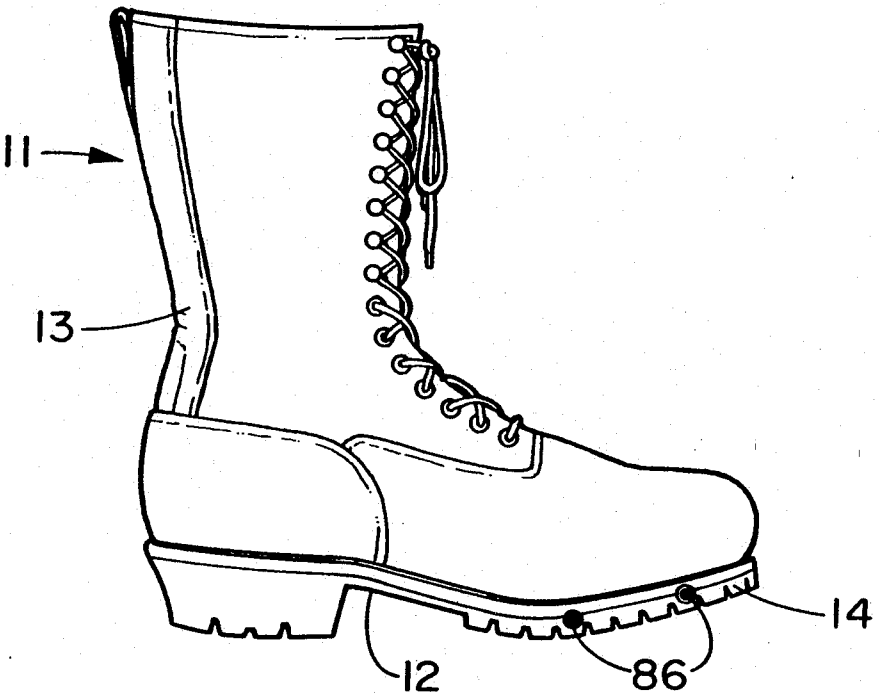
FIG. 33 is a side elevational view of a boot showing spaced-apart fastening means in the sole plane of the boot.

The front of the gaiter 10 which is protecting the toe and instep portions of the cover in a preferred embodiment, is secured to the sole plane or side of the sole of the boot or shoe by a removable fastening means. Preferably, the fastening means can be easily fastened and unfastened by the wearer of the gaiter 10 using only the wearer's hands without requiring any tools or instruments. The gaiter 10 has a plurality of spaced-apart fastening means 85 attached to the lower edge 83 of the side portions 19, 20 of the cover 10. These fastening means 85 cooperate with a corresponding plurality of spaced-apart fastening means 86 on the sole plane 14 of the shoe or boot (FIGS. 31–34). A plurality of flaps 87 are attached to the lower edges 83 of the side portions 19, 20 and, in one embodiment, a male snap-type fastener 85 is attached to each respective flap. This fastener 85 cooperates With a female snap-type fastener 85 which is connected to the sole plane 14 of the shoe or boot. Although the male and female fasteners may be reversed, i.e., the male fastener in the shoe and the female fastener on the gaiter 10, the female fastener is preferred in the shoe to reduce problems which could occur due to projections from a male fastener extending from the sole plane 14 of the shoe or boot and interfering with the walking of the wearer of the shoe or boot. This positive fastening means assures that the cover 10 is secured to the front portion of the shoe or boot and that the cover 10 is not detached or separated from the shoe or boot under the forces applied to the cover 10 when contacted by the high speed blade of the chainsaw. Other types of positive fastening means may be used besides the male and female snap-type fasteners. Preferably the fastening means are transverse to the sole plane 14 of the shoe or boot and the fastening means in the sole plane of the shoe is mounted in a bore or opening in the side of the sole (FIG. 34). The sole plane 14 of the shoe or boot may have threaded opening 88 formed therein and a cooperating threaded shaft 89 may be attached to the lower edge 83 of the side portions 19, 20. The shaft 89 may be inserted through openings in the lower edge 83 of the side portions 19, 20 or through openings in the flaps 87. The unthreaded end of the shaft 89 may have a head of any desired configuration such as coin shape, hexagonal, wing, slotted, etc. This fastening means would not permit the wearer of the gaiter 10 to fasten and unfasten the fastening means very rapidly and might require a tool or instrument to perform the threading connection. Hook and loop type fastening means would not be effective as a fastening means between the gaiter and the side of the sole since the forces applied by the chainsaw to the gaiter would overcome the fastener.

The attachment of the gaiter 10 to the front portion of the shoe is further supplemented by the strap means 21 which extends around the arch of the shoe or boot and is releasably attached to the second side portion 20 of the cover 10. A strap means 21 is preferred over an elastic band to assure that the cover is firmly secured and will not be detached from the shoe under the forces produced by contact of the cover by a chainsaw blade. An elastic band permits movement of the cover 10. Furthermore, an elastic band connected to both side portions 19, 20 would restrict the wearer in putting on the gaiter 10 since the gaiter 10 would have to be slipped over the toe of the shoe or boot.

The method of fabricating the particularly preferred embodiment is very similar to the fabrication of the embodiments as previously described. The patterns for the outside cover 30 and the inside cover 31 are substantially unchanged. Also, the patterns formed from lining means 32 such as woven and non-woven para aramid are substantially unchanged. The particularly preferred embodiment, however, is fabricated from eight layers of lining means 32, an outer layer 30, an inner layer 31, a folded segment 98 of lining means and a bias binding 75 about the periphery of the gaiter as shown in FIG. 28. The folded segment 98 is sewn to the multiple layers of lining means 32 by a basting-type stitch 99. Also the cord 82 of lining means 32 is attached to the cover on the lower edge of each side portion by being sewn to the bias binding 75. Further, the inner cover 31, the outer cover 30 and the layers of lining means 32 are joined together with a quilt-like stitching 80 as shown in FIG. 27. The lower portion of each side portion 19, 20 of the particularly preferred embodiment also has attached thereto a plurality of spaced-apart flaps 87. Preferably, these flaps 87 are sewn to the lower portion of each side portion after the bias binding 75 has been sewn on the gaiter. The fastening means 85 are attached to the respective flaps 87 by a means which is dependent on the type of fastener. A snap type fastener is press fitted into the flap. For use with a shaft-type fastener, an opening is formed in the flap to receive the shaft, the opening being smaller than the head of the shaft-type fastener.

Thus, the present invention discloses an effective protective cover for the feet and ankles of persons using chainsaws and other high speed cutting equipment A flexible fabric covering is provided which is easily and rapidly attached over the shoe/boot of the person and can be adapted to fit a wide variety of shoe sizes. The cover is easily fabricated without the need of special equipment.

Obviously, many modifications may be made without departing from the basic spirit of the present invention. Accordingly, it will b appreciated by those skilled in the art that within the scope of the appended claims, the invention may be practiced other than has been specifically described herein.

What is claimed is:

1. A removable cover intended to protect the foot of a person in combination with a shoe worn by said person, particularly when the person is using a chainsaw to cut timber, foreset products and lumber the cover being wrapped around the shoe on the person's foot and being substantially universal for a variety of shoe sizes, wherein the shoe includes a toe portion, an instep, a sole plane, said portions joining the instep and sole plane, respectively, and a back portion, the cover comprising a flexible multi-layer unitary member including an inner fabric layer, an outer fabric layer and an aramid lining therebetween, the aramid lining impeding the chainsaw and substantially jamming the same in the even the chainsaw is accidentally brought into contact with the cover and cuts into the cover, the cover further comprising a substantially-flat member having a central forwardly-disposed upwardly projecting portion slipped over the toe portion and instep of the shoe, the shoe being received within the cover as the cover is wrapped around the shoe, the cover having respective side portions including a left side portion and a right side portion, each side portion having a respective upper portion and a respective lower portion, the upper portion of each side curving downwardly toward the back portion of the shoe, the lower portion of each side curving upwardly toward the back portion of the shoe, one of the side portions having a rearwardly-extending tab formed thereon, the tab extending substantially continuously from the upwardly curving portion to the downwardly curving portion of side portions of the cover, the other side portion having a loop means thereon through which the tab is received, the tab being grasped and pulled through and around the loop means to tighten the cover on the shoe, first quick-release fastening means between the tab and the one side portion of the cover to secure the cover to the shoe longitudinally thereof, and means for detachably securing the lower portion of each side portion of the cover to the sole plane of the shoe whereby the cover is precluded from being separated from the shoe upon contact between the chainsaw and the cover.

2. The cover of claim 1, further comprising the second side portion having a bail thereon through which the tab is received, the tab being grasped, pulled through, and approximately 180° around the bail to tighten the cover on the shoe, the tab being fastened to the first side portion of the cover.

3. The removable cover of claim 1, wherein the protective cover has a maximum height between the upper portion and the lower portion, the vertical height of the tab being approximately 30–60% of the maximum height of the cover.

4. The removable cover of claim 3, wherein the vertical height of the tab is approximately 45% of the maximum height of the cover.

5. The removable cover of claim 1, wherein the aramid lining comprises at least a woven para aramid fabric first layer and at least a non-woven para aramid fabric adjacent second layer.

6. The removable cover of claim 5, wherein the aramid lining comprises six woven para aramid fabric layers and two non-woven para aramid fabric layers.

7. The removable cover of claim 6, wherein the aramid lining comprises the layers arranged adjacently as two woven layers, a non-woven layer, two woven layers, a non-woven layer and two woven layers.

8. The removable cover of claim 1, further comprising the lower portion of each side of the aramid lining having an edge thereon, a separate segment of woven para aramid fabric, the separate segment being folded about the edge of the lower portion of each side of the aramid lining and extending inwardly from the respective edges toward the instep to cover the lower portion of each side of the aramid lining, the separate segment being attached to the lower portion of each side of the aramid lining.

9. The removable cover of claim 1, wherein the aramid lining, the inner fabric layer and the outer fabric layer of the cover are joined together by stitching in a pattern to form a plurality of compartments wherein the aramid lining is prevented from being displaced from between the compartments and from between the inner fabric layer and the outer fabric layer when the chainsaw is brought in contact with the aramid lining.

10. The removable cover of claim 1, further comprising the lower portion of each side having an edge thereon, a cord formed from the aramid lining, said cord being attached the edge of the lower portion of each side of the cover wherein, when the chainsaw contacts said edge of the cover, said cord binds the chainsaw and prevents injury to the person using the chainsaw.

11. The removable cover of claim 1, wherein the sole plane of the shoe is substantially parallel to the ground, the sole plane having a plurality of spaced-apart transverse fastening means mounted thereon, wherein the fastening means are substantially parallel to the ground the lower portion of each side portion of the cover having a corresponding plurality of spaced-apart fastening means connected thereto, the fastening means on the sole plane of the shoe removably cooperating with the fastening means on the cover.

12. The removable cover of claim 11, wherein the fastening means on the sole plane of the shoe is a snap-type female fitting and the fastening means on the cover is a snap-type male fitting.

13. The removable cover of claim 1, wherein the person's shoe has an arch, the cover further having a strap means attached to the lower portion of first side portion, the strap having an end extending around the arch of the person's shoe and means for releasably attaching the end of the strap to the second side portion of the cover.

14. A flexible protective cover of use with chainsaws to protect feet, shoes and boots having an arch, a toe, a back, a sole plane, an outer side, an inner side and an instep, the protective cover comprising a multiple layer fabric body which, when laid out, is substantially flat having an upwardly projecting portion and, when folded is contoured as a cover to conform to the instep of the shoe and extend to the ankle, the upwardly projecting portion conforming to the toe of the shoe, the folded body extending from the instep of the shoe, on both the outer side and the inner side of the shoe, downwardly to the sole plane of the shoe and backwardly to cover the back of the shoe, wherein the cover may fit a wide variety of shoe sizes; releasable means for securing the folded body around the arch of the shoe; the multiple layer fabric body, when folded, further having a first side and a second side each side having a respective upper portion and a respective lower portion, the upper portion of each side curving downwardly toward the back of the shoe, the lower portion of each side curving upwardly toward the back of the shoe; a tab extending outwardly from the first side of the fabric body beyond the back of the shoe the tab; the tab extending substantially continuously from the upwardly curving portions to the downwardly curving portions of the sides of the body; means for releasably connecting the tab to the second side of the fabric body around the back of the shoe, such that the folded body is secured around the back of the shoe; the multiple layer fabric body comprising at least a first outer layer, a second inner layer and an aramid lining therebetween, the aramid lining being a fabric material to impede the substantially jam the chainsaw in the even the chainsaw is brought into contact with the cover, the aramid lining being secured between the outer layer and the inner layer by a stitching pattern to form a plurality of compartments wherein the aramid lining is prevented from being displaced from between the compartments and from between the outer layer and the inner layer when the chainsaw is brought into contact with the cover.

15. A flexible protective cover for use with chainsaws to protect feet, shoes and boots having an arch, a toe, a back, a sole plane, an outer side, an inner side and an instep, the protective cover comprising a multiple layer fabric body which, when laid out, is substantially flat having an upwardly projecting portion and, when folded, is contoured as a curve to conform to the instep of the shoe and extend to the ankle, the upwardly projecting portion conforming to the toe of the shoe, the folded body extending from the instep of the shoe, on both the outer side and the inner side of the shoe, downwardly to the sole plane of the shoe and backwardly to cover the back of the shoe, the folded body having a lower edge conforming to the sole plane of the shoe wherein the cover may fit a wide variety of shoe sizes; releasable means for securing the folded body around the arch of the shoe, the multiple layer fabric body, when folded, further having a first side and a second side each side having a respective upper portion and a respective lower portion, the upper portion of each side curving downwardly toward the back of the shoe, the lower portion of each side curving upwardly toward the back of the shoe; a tab extending outwardly from the first side of the fabric body beyond the back of the shoe the tab; the tab extending substantially continuously from the upwardly curving portions to the downwardly curving portions of the sides of the body; means for releasably connecting the tab to the second side of the fabric body around the back of the shoe, such that the folded body is secured around the back of the shoe, the multiple layer fabric body comprising at least a first outer layer, a second inner layer and an aramid lining therebetween, the aramid lining being a fabric material to impede and substantially jam the chainsaw in the event the chainsaw is brought into contact with the cover, a cord formed from a high modulus fiber, said cord being attached to the lower edge of the cover wherein when the chainsaw contacts the lower edge of the cover, said cord initiates impedance to the chainsaw and prevents injury to the feet of the wearer of the chainsaw.

16. A removable cover intended to protect the foot of a person, particularly when the person is using a chainsaw to cut timber, forest products and lumber, the cover being wrapped around the shoe on the person's foot and being substantially universal for a variety of shoe sizes, wherein the shoe includes a toe portion, an instep, a sole plane, side portions joining the instep and sole plane, respectively, and a back portion, the cover comprising a flexible multi-layer unitary member including an inner fabric layer, an outer fabric layer and a aramid lining means therebetween, the lining means to impede the chainsaw and substantially jam the same in the event the chainsaw is accidentally brought into contact with the cover and cuts into the cover, the cover further comprising a substantially-flat member having a central forwardly-disposed upwardly projecting portion slipped over the toe portion and instep of the shoe, the shoe being received within the cover as the cover is wrapped around the shoe, the cover having respective side portions including a first side portion and a second side portion, each side portion having a respective upper portion and a respective lower portion, the upper portion of each side curving downwardly toward the back portion of the shoe, the lower portion of each side curving upwardly toward the back portion of the shoe, the first side portion having a rearwardly-extending tab formed thereon, the tab having a vertical height extending substantially continuously from the upwardly curving portion to the downwardly curving portions of side portions of the cover, the second side portion having a bail thereon through which the tab is received, the tab being grasped and pulled through, and approximately 180° around, the bail to tighten the cover on the shoe, quick-release fastening means between the tab and the fist side portion of the cover to secure the cover to the shoe or boot longitudinally thereof, and means for detachably securing the lower portion of each side portion of the cover to the sole plane of the shoe whereby the cover is precluded from being separated from the shoe upon contact between the chainsaw and the cover.

* * * * *